US010644384B1

(12) United States Patent
Ozdemir et al.

(10) Patent No.: US 10,644,384 B1
(45) Date of Patent: May 5, 2020

(54) ZERO WEIGHT AIRBORNE ANTENNA WITH NEAR PERFECT RADIATION EFFICIENCY UTILIZING CONDUCTIVE AIRFRAME ELEMENTS AND METHOD

(71) Applicant: Virtual EM Inc., Ann Arbor, MI (US)

(72) Inventors: Tayfun Ozdemir, Ann Arbor, MI (US); Christopher N. Davis, Ann Arbor, MI (US)

(73) Assignee: VIRTUAL EM INC.

( * ) Notice: Subject to any disclaimer, the term of this patent is extended or adjusted under 35 U.S.C. 154(b) by 0 days.

(21) Appl. No.: 16/582,400

(22) Filed: Sep. 25, 2019

Related U.S. Application Data

(63) Continuation-in-part of application No. 15/973,448, filed on May 7, 2018, now Pat. No. 10,468,758.

(51) Int. Cl.

| | |
|---|---|
| ***H01Q 9/40*** | (2006.01) |
| ***H01Q 1/28*** | (2006.01) |
| ***H01Q 1/52*** | (2006.01) |
| ***H01Q 9/28*** | (2006.01) |

(52) U.S. Cl.
CPC ..... *H01Q 1/28* (2013.01); *H01Q 1/521* (2013.01); *H01Q 9/28* (2013.01); *H01Q 9/40* (2013.01)

(58) Field of Classification Search
CPC ..... H01Q 1/28; H01Q 1/521; H01Q 9/28; H01Q 9/40
USPC ..... 343/702, 708
See application file for complete search history.

(56) References Cited

U.S. PATENT DOCUMENTS

| | | | |
|---|---|---|---|
| 2,510,698 | A | 6/1950 | Johnson |
| 3,365,721 | A | 1/1968 | Bittner |
| 3,564,134 | A | 2/1971 | Rue |
| 3,587,102 | A | 6/1971 | Czerwinski |
| 3,646,562 | A | 2/1972 | Acker et al. |
| 3,701,157 | A | 10/1972 | Uhrig |
| 3,742,495 | A | 6/1973 | Diamantides |
| 4,100,546 | A | 7/1978 | Campbell et al. |
| 4,117,490 | A | 9/1978 | Arnold et al. |
| 5,231,409 | A | 7/1993 | Astier et al. |
| 6,119,976 | A | 9/2000 | Rogers |
| 7,053,812 | B2 | 5/2006 | Trainor |
| 7,467,762 | B1 | 12/2008 | Parsons |
| 8,115,145 | B2 | 2/2012 | Shariff |
| 8,282,040 | B1 | 10/2012 | Westman et al. |
| 9,337,889 | B1 | 5/2016 | Stapleford |
| 2008/0210818 | A1 | 9/2008 | Chiu et al. |

(Continued)

*Primary Examiner* — Graham P Smith
(74) *Attorney, Agent, or Firm* — J. Gordon Lewis

(57) ABSTRACT

An aircraft includes a fuselage assembly including a first elongated structural member formed of electrically conductive material, at least one wing assembly including a second structural member formed of electrically conductive material, at least one horizontal stabilizer assembly including a third structural member formed of electrically conductive material, and at least one vertical stabilizer assembly including a fourth structural member formed of electrically conductive material. The wing assembly, the horizontal stabilizer, and the vertical stabilizer are each interconnected with the fuselage assembly in a flight configuration normal to the fuselage. The first, second, third and fourth structural members are electrically insulated from one another. An electronic communication device within the aircraft is configurable for selective electrical interconnection of two or more of said structural members to form a dipole or monopole type transmitting/receiving antenna.

24 Claims, 19 Drawing Sheets

(56) References Cited

U.S. PATENT DOCUMENTS

| | | | |
|---|---|---|---|
| 2009/0322147 | A1 | 12/2009 | Cooney |
| 2015/0236778 | A1 | 8/2015 | Jalali |
| 2015/0237569 | A1 | 8/2015 | Jalali |

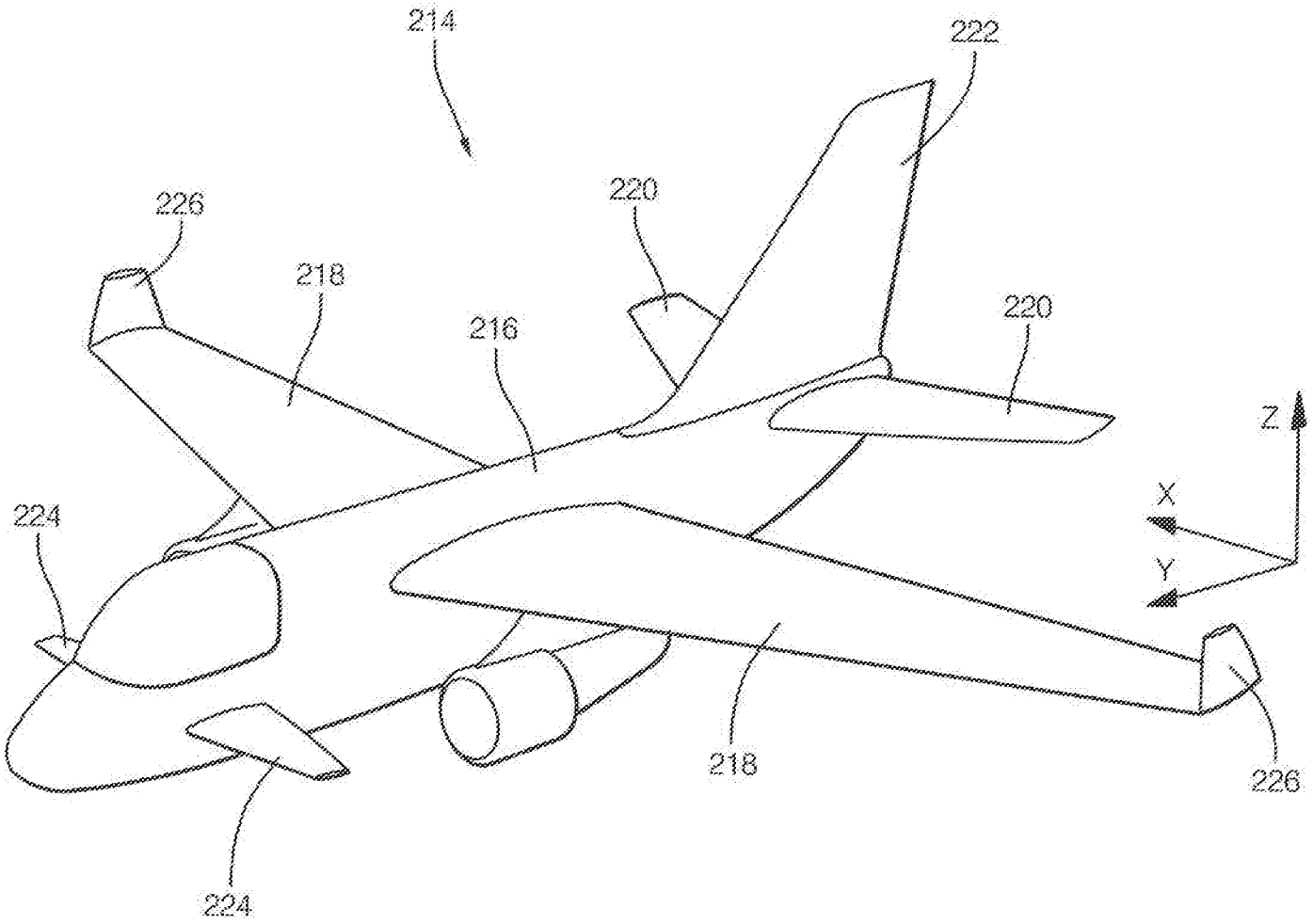
FIG. 0.1

| DESCRIPTION | WIRING TOPOLOGY | POLARIZATION |
|---|---|---|
| WING DIPOLE | 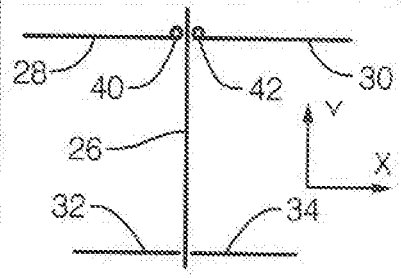 | X |
| HORIZONTAL STABILIZER DIPOLE | 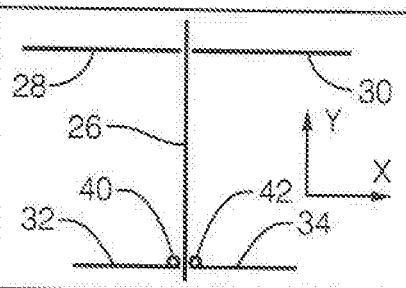 | X |
| VERTICAL STABILIZER MONOPOLE | 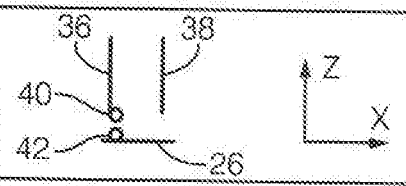 | Z |
| VERTICAL STABILIZER MONOPOLE ARRAY | 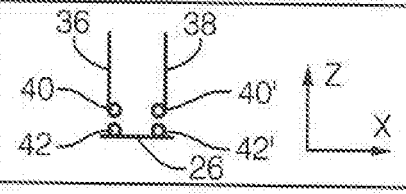 | Z |
| FUSELAGE MONOPOLE WITH WINGS (CONNECTION POINT FOR WINGS CAN BE EITHER LEFT OR RIGHT WING. DIAGRAM SHOWS RIGHT WING) | 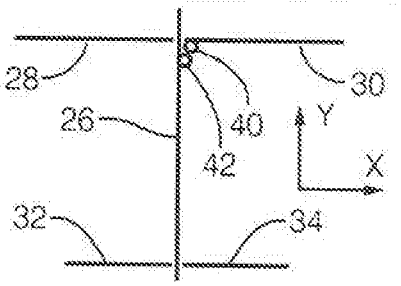 | Y |
| FUSELAGE MONOPOLE WITH HORIZONTAL STABILIZERS (CONNECTION POINT FOR HORIZONTAL STABILIZER CAN BE EITHER LEFT OR RIGHT STABILIZER. DIAGRAM SHOWS RIGHT STABILIZER) | 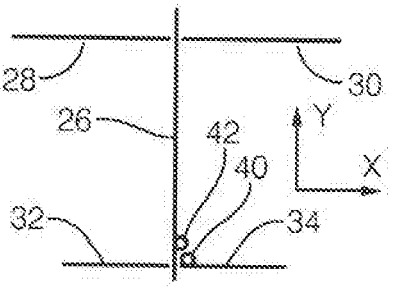 | Y |

FIG. 2

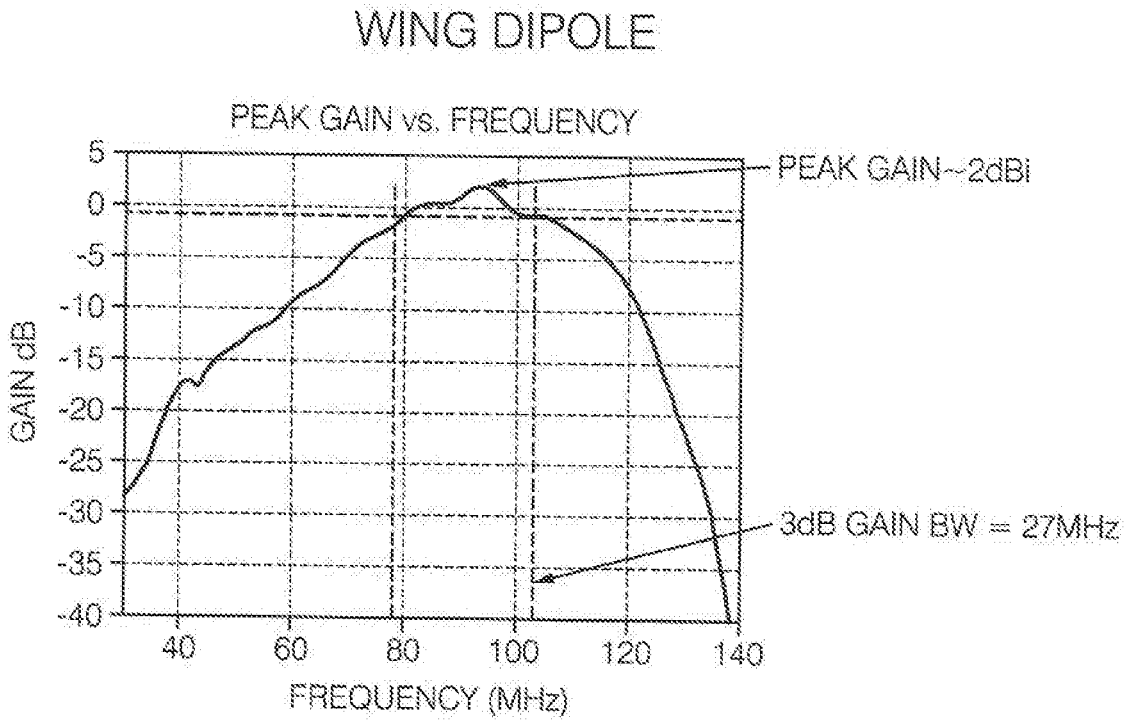
FIG 5A1
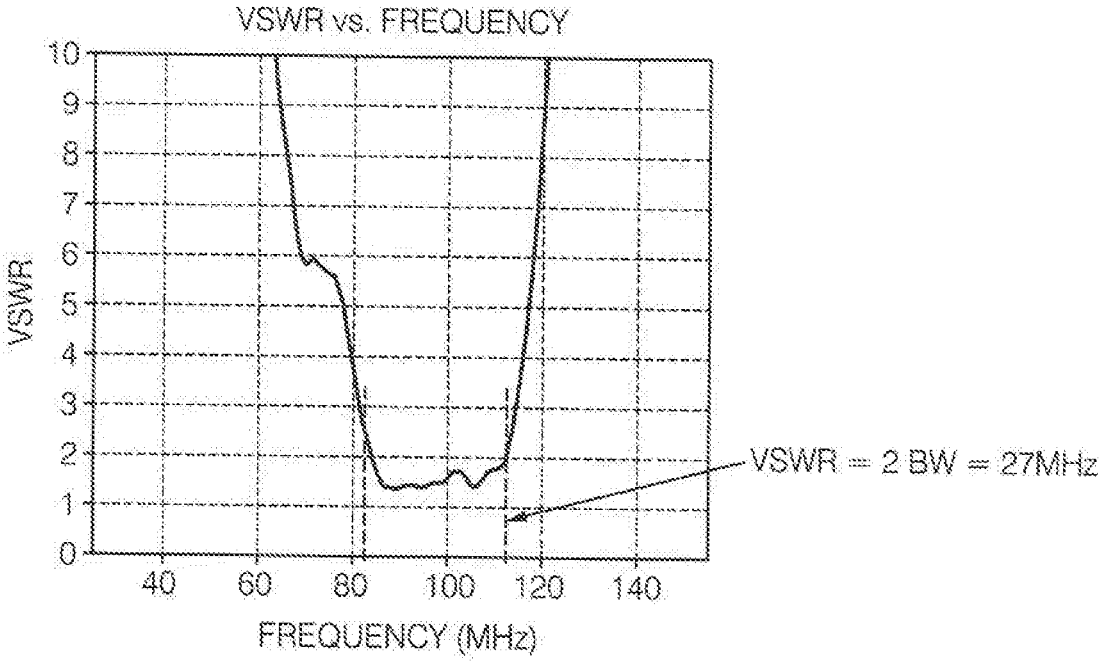
FIG 5A2

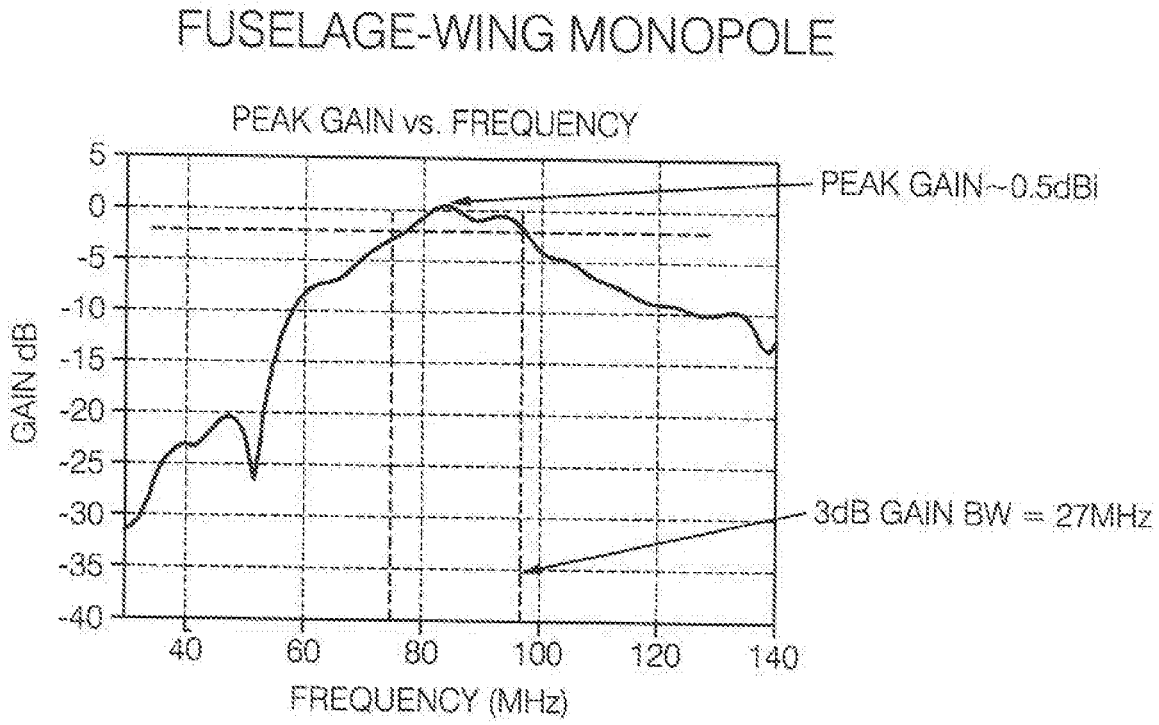
FIG 5B1
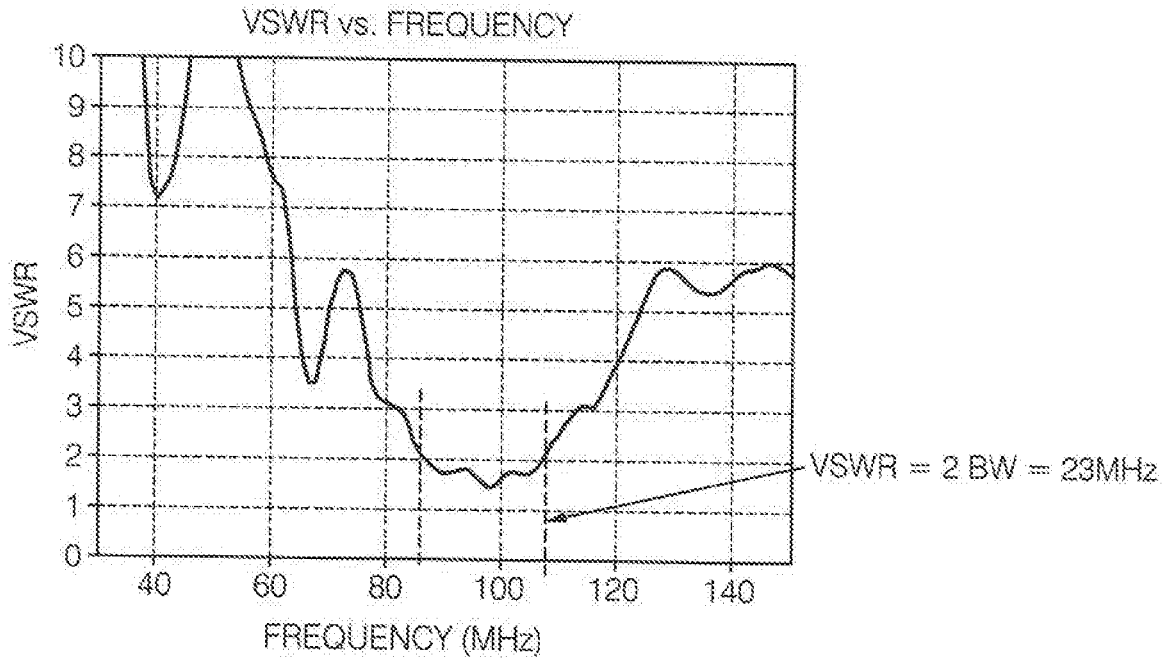
FIG 5B2

WING DIPOLE
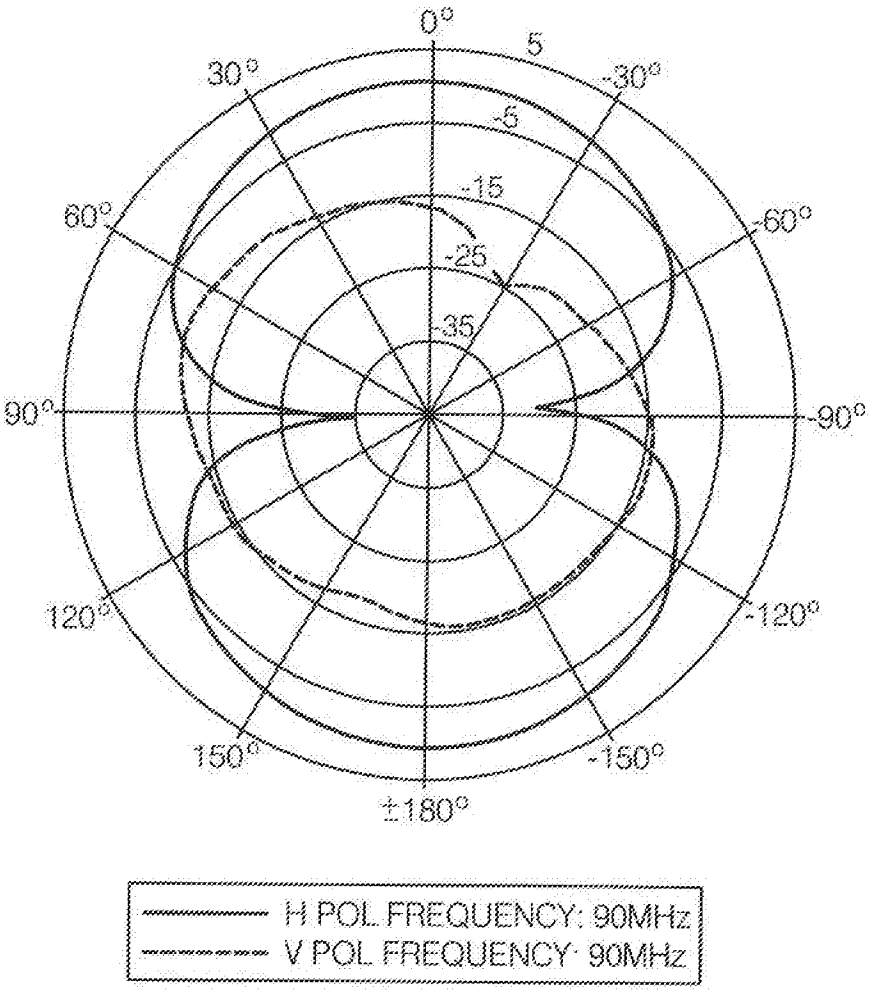
FIG. 6A2
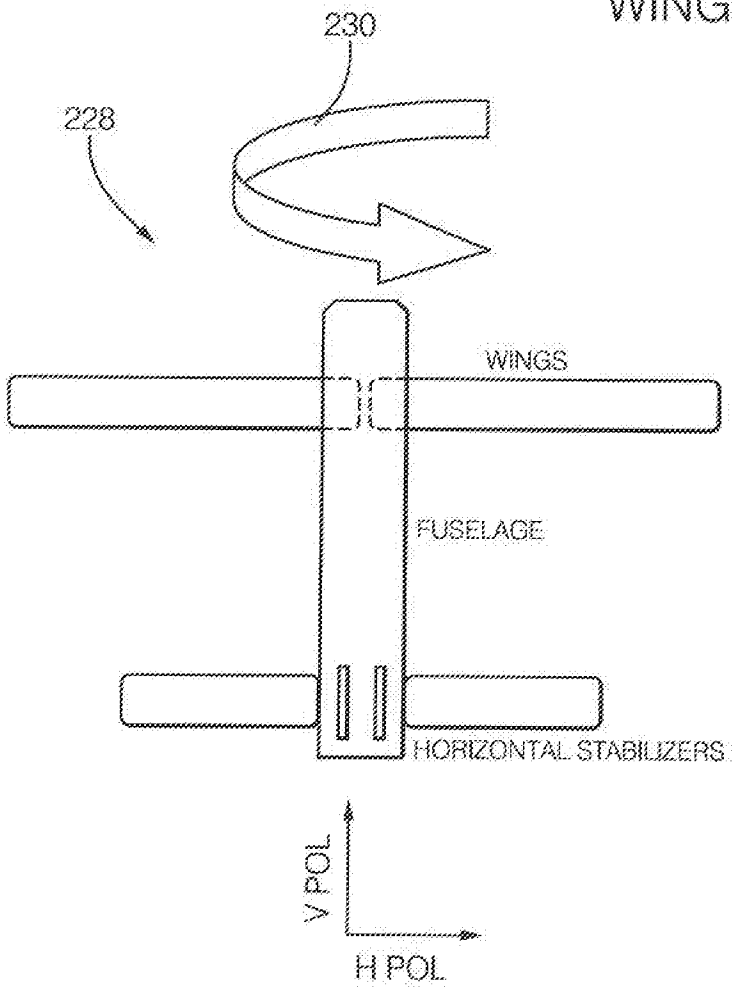
FIG. 6A1

FUSELAGE-WING MONOPOLE
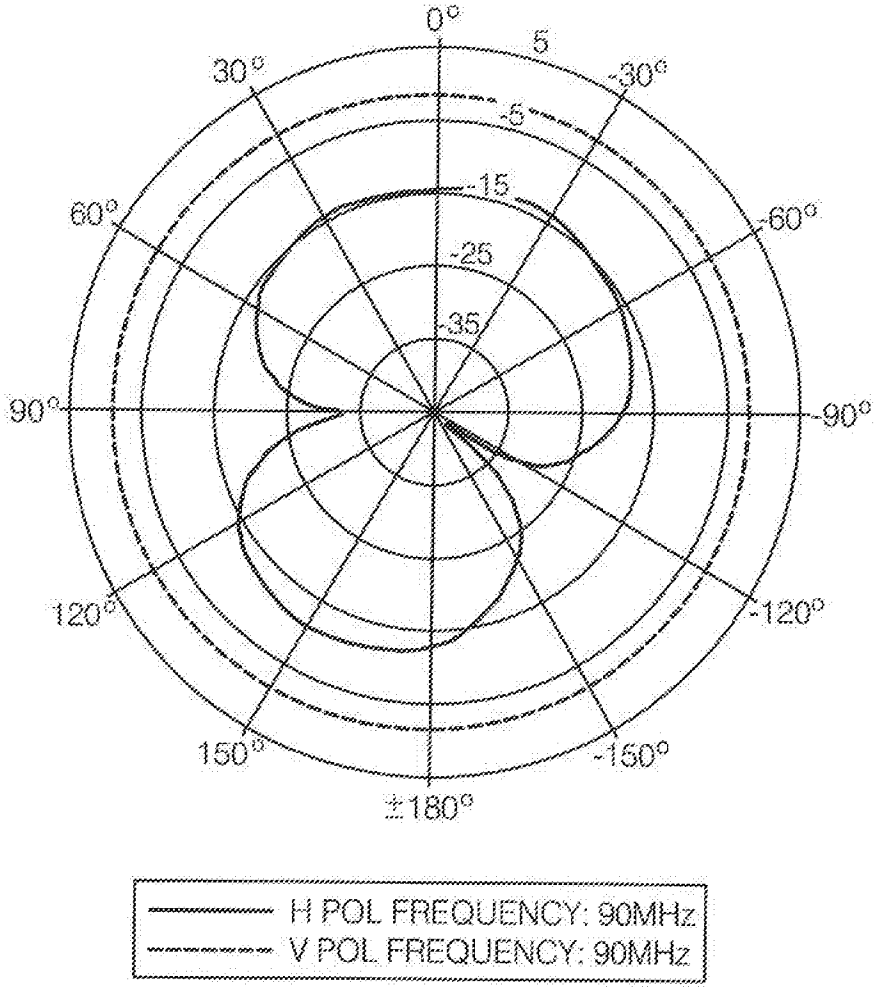
FIG. 6B2
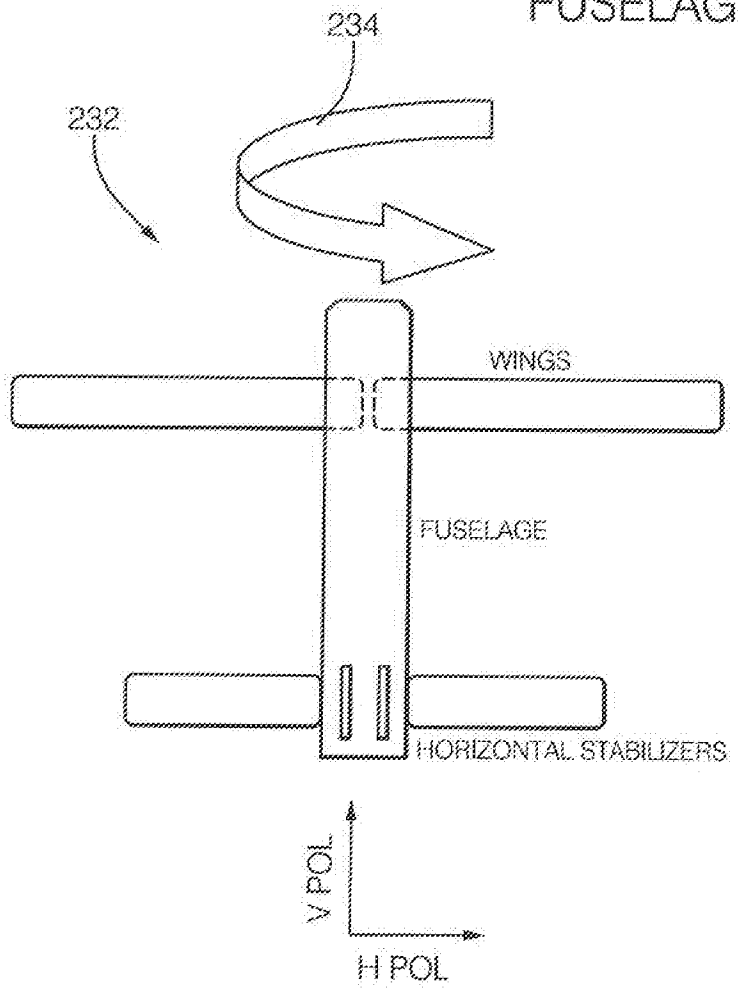
FIG. 6B1

ZERO WEIGHT AIRBORNE ANTENNA WITH NEAR PERFECT RADIATION EFFICIENCY UTILIZING CONDUCTIVE AIRFRAME ELEMENTS AND METHOD

RELATED PATENT APPLICATIONS

This application is a continuation-in-part and claims priority to U.S. patent application Ser. No. 15/973,448 filed 7 May 2018, entitled "Zero Weight Airborne Antenna with Near-Perfect Radiation Efficiency Utilizing Conductive Airframe Elements and Method".

GOVERNMENT RIGHTS STATEMENT

The government has rights to this invention pursuant to Contract No. N00014-14-C-0076 awarded by the U.S. Department of Defense (Office of Naval Research) entitled "Efficient HF Transmit Antennas Utilizing Platform Coupling and Reconfigurable Aperture".

TECHNICAL FIELD

The present invention is related to aircraft antenna systems, and more particularly, the incorporation of such antenna systems within a host airframe, and more particularly still, the incorporation of such antenna systems within field launched drones and unmanned aerial vehicles. Furthermore, the present continuing invention extends the parent invention to rotary wing aircraft.

BACKGROUND OF THE INVENTION

The integration of wide-band high efficiency antennas into airframes especially at low frequencies is very difficult for two reasons: (1.) such antenna need to be large and cannot be protruding out of the airframe, and (2.) because most airframes are electrically conductive (aluminum or carbon-fiber), a conformational antenna printed on such surfaces have narrow bandwidth and low efficiency.

A search of issued U.S. patents in the field of aircraft antennas and related apparatus reveals U.S. patents related generally to the field of the present invention but which do not anticipate nor disclose the device of the present invention. The discovered U.S. patents relating generally to the present invention are discussed herein below.

U.S. Pat. No. 4,100,546 to Campbell et al. entitled "Airborne Antenna System Employing the Airframe as an Antenna" and U.S. Pat. No. 4,117,490 to Arnold et al. entitled "Inconspicuous Antenna System Employing the Airframe as an Antenna" each disclose a phase front homing system airborne antenna array employing portions of the airframe as two antenna elements. The invention provides an improved phase homing system antenna wherein the antenna elements are concealed or greatly reduced in profile. The antenna system comprises two substantially vertical sections of the airframe of the airplane. Included also are respective metallic toroid coils encompassing each of the vertical airframe sections and electromagnetically coupled thereto. The combination of each vertical section and its associated toroid coil comprises a respective antenna and corresponding terminals of the toroid coils comprise the radio frequency feed terminals to the respective antennas. The phase front homing system derives the desired sense of direction to a prescribed beacon transmitter by utilizing directly the phase difference at the two antenna elements.

U.S. Pat. No. 3,587,102 to Czerwinski entitled "Helicopter Skid Antenna" discloses a system of struts which are disposed perpendicular to the roll axis of a helicopter for supporting the landing skids thereof and are insulated from the helicopter fuselage. One of the struts has an antenna feed at its center, thereby the entire landing gear assembly functions as a folded dipole antenna or a loop antenna, depending on the operating frequency.

U.S. Pat. No. 2,510,698 to Johnson entitled "Radio Aerial, Particularly for Aircraft and Other Vehicles", discloses an antenna design suitable for modern high speed aircraft, inter alia, wherein structural difficulties arise in fitting conventional (mast or wire) aerials external of the airframe. A mast type of aerial in the form of a wire stretched between two suitable external points of the host aircraft is subject to large aerodynamic forces such that it either becomes torn away from its supports, or due to its mechanical drag seriously interferes with the aerodynamic performance of the aircraft, besides being liable to a form of electrical interference known as precipitation static, as well as being a source of danger to the aircraft due to the possibility of fracture when flying at very high speeds approaching the speed of sound. Johnson provides a simple and unobtrusive radio aerial employing the metallic surface of the airframe structure to which it is applied and inductively couples the metallic surface to radio transmitting or receiving equipment whereby the surface is excited by the inductive coupling to effect radiation when radio signals are being transmitted or the inductive coupling is excited by the currents induced in the surface by electromagnetic radiations of a received radio signal. The inductive coupling may comprise one or more toroidal windings of wire which may either surround the metallic surface with the plane of the toroid or coil perpendicular to the axis of the surface or it may be concentrated at one or more points adjacent the metallic surface. In one application, the inductive coupling is mounted adjacent to the wing root, but external to the metal fuselage of the aircraft, whereby it sets up a magnetic field encircling the wing root or a portion thereof. One feature of the invention resides in associating the inductive coupling with two metallic structural parts whose longitudinal axes are mutually inclined so that the two parts act as crossed dipoles. When this feature is applied to an aircraft, the metallic wing and fuselage, or metallic portions of the fuselage and wing have an appropriate induction coil mounted adjacent to them in a manner which gives the required polar diagram of magnetic field.

None of the above listed U.S. patents disclose or suggest a zero weight antenna for aircraft utilizing conductive aircraft elements and method of the present invention. U.S. Pat. No. 4,100,546 to Campbell et al. and U.S. Pat. No. 4,117,490 to Arnold et al. describe an antenna realized by exciting the landing gear of a fixed-wing aircraft via inductive coupling. Neither Campbell nor Arnold reveal that the landing gears are electrically isolated from the aircraft body and biased against each other, which would be relevant to the present invention. Instead, both Campbell and Arnold claim to generate monopoles via inductive coupling. Similarly, U.S. Pat. No. 3,587,102 to Czerwinski describes a loop antenna realized by exciting the landing gear of a helicopter via direct electrical contact when the landing gear is electrically isolated from the body of the aircraft and via inductive coupling in the absence of electrical isolation. Czerwinski does not reveal that the body of the aircraft is biased against the landing gear to generate an antenna, which would be relevant to the present invention. U.S. Pat. No. 2,510,698 to Johnson proposes excitation of sections of the aircraft's airframe via inductive coupling at multiple locations to facilitate radiation and reception of radio waves. Johnson does not propose to isolate sections of the airframe from each other electrically and bias them against each other to form dipoles and monopoles, which is the essence of the present invention. Each of the above listed U.S. patents and published applications (i.e., U.S. Pat. Nos. 4,100,546; 4,117,490; 3,587,102; and 2,510,698) are hereby incorporated herein by reference.

SUMMARY OF THE INVENTION

The forgoing problems and limitations are overcome and other advantages are provided by new and improved conformal and zero net weight wide-band high efficiency antennas incorporated within airframes.

Therefore, it is an object of the present invention to provide a zero net weight antenna for aircraft employing pre-existing conductive airframe elements.

The present invention provides an aircraft with a fuselage assembly including a first elongated structural member formed of electrically conductive material and at least one airfoil assembly including a second structural member formed of electrically conductive material. The airfoil is interconnected with the fuselage assembly in a flight configuration wherein the first and second structural members are electrically insulated from one another. Airfoil assembly may have opposed pair of symmetric sections including an apposed pair of said second structural members electrically isolated from each other and from the fuselage. An electronic communication device disposed within said aircraft is configurable for selective electrical interconnection of said first and second structural members or for selective electrical interconnection of the pair of second structural members to form a transmitting/receiving antenna.

According to one aspect of the invention, the airfoil consists of a concentric opposed pair of main wings including an aligned pair of said second structural members, and wherein the electronic communication device is operable for selective electrical interconnection of the pair of second structural members to form a wing dipole antenna.

According to another aspect of the invention, the electronic communication device is operable for selective electrical interconnection of the first structural member with one of the pair of second structural members to form a fuselage-wing monopole antenna.

According to yet another aspect of the invention, the airfoil comprises a concentric opposed pair of horizontal stabilizers including an aligned pair of second structural members. The electronic communication device is operable for selective electrical interconnection of the pair of second structural members to form a horizontal stabilizer dipole antenna.

According to yet another aspect of the invention, the electronic communication device is operable for selective electrical interconnection of the first structural member with one of the pair of second structural members to form a fuselage-horizontal stabilizer monopole antenna.

According to yet another aspect of the invention, the electronic communication device is operable for selective electrical interconnection of the first structural member with the second structural member to form a vertical stabilizer monopole antenna.

According to yet another aspect of the invention, the electronic communication device is operable for selective electrical interconnection of the first structural member with each of the second structural members to form a vertical stabilizer monopole antenna array.

According to yet another aspect of the invention, the aircraft includes a fuselage assembly including an elongated structural member formed of electrically conductive material, at least one wing assembly including a second structural member formed of electrically conductive material, at least one horizontal stabilizer assembly including a third structural member formed of electrically conductive material, at least one vertical stabilizer assembly including a fourth structural member formed of electrically conductive material, wherein the wing assembly, the horizontal stabilizer, and the vertical stabilizer are each interconnected with the fuselage assembly in a flight configuration substantially normal to said fuselage, wherein the first, second, third and fourth structural members are electrically insulated from one another and from the fuselage. Furthermore, an electronic communication device is disposed within the aircraft and is configurable for selective electrical interconnection of one of the structural members with at least one other of the structural members to form a transmitting/receiving antenna or for selective electrical interconnection of one of the structural members with at least one other of the structural members while at least one of the rest of the structural members is electrically connected to one other structural member to form a transmitting/receiving antenna.

These and other features and advantages of this invention will become apparent upon reading the following specification, which, along with the drawings, describes preferred and alternative embodiments of the invention in detail.

BRIEF DESCRIPTION OF THE DRAWINGS

The present invention will now be described, by way of example, with reference to the accompanying drawings, in which:

FIG. 0.1, is perspective view of a typical airframe showing fuselage, wings, horizontal stabilizers, vertical stabilizer, canards, and winglets, each of which can be used to form dipole antennas, monopole antennas and arrays of them by selectively electrically isolating some and interconnecting the rest;

FIG. 2, is a table of the electrical topography of differing antenna embodiments of the present invention including a wing dipole antenna, a horizontal stabilizer dipole antenna, a vertical stabilizer monopole antenna, a vertical stabilizer monopole antenna array, a fuselage monopole antenna employing aircraft wings, and a fuselage monopole antenna employing aircraft horizontal stabilizers;

FIGS. 5A1 and 5A2, show the variation of the measured maximum gain and Voltage Standing Wave Ratio (VSWR) of an example wing dipole antenna with the frequency realized using a medium size Unmanned Aerial Vehicle (UAV) made of carbon-fiber airframe;

FIGS. 5B1 and 5B2, show the same data as FIGS. 5A1 and 5A2 but for an example fuselage-wing monopole antenna realized using the same UAV;

FIGS. 6A1 and 6A2, show the measured Horizontal Polarization (H-Pol) and Vertical Polarization (V-Pol) gain patterns of the antenna of FIGS. 5A1 and 5A2 at 90 MHz;

FIGS. 6B1 and 6B2, show the measured H-Pol and V-Pol gain patterns of the antenna of FIGS. 5A1 and 5A2 at 90 MHz;

Figure 1A:
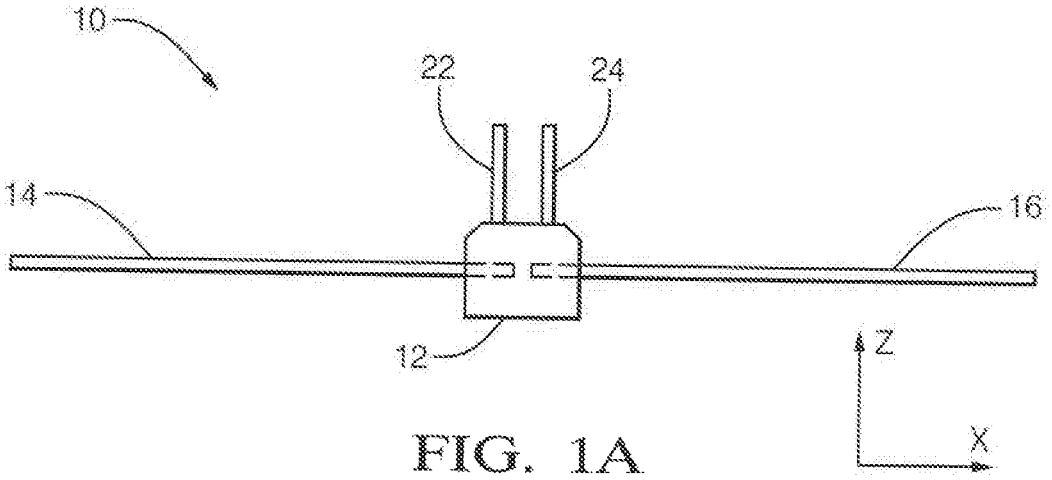
FIG. 1A, is a schematic front plan view of a typical aircraft airframe employed to form integral dipole and monopole antennas.

Although the drawings represent embodiments of the present invention, the drawings are not necessarily to scale and certain features may be exaggerated in order to illustrate and explain the present invention. The exemplification set forth herein illustrates an embodiment of the invention, in one form, and such exemplifications are not to be construed as limiting the scope of the invention in any manner.

DESCRIPTION OF THE PREFERRED EMBODIMENTS

The varied embodiments of the present invention disclosed herein add zero or de minimis additional weight to the host aircraft, is invisible, requires minimal wiring and forms extremely high efficiency antennas (often times, achieving the theoretical limit).

The present invention comprises an apparatus and method for isolating and combining select electrically conductive sections of an airframe to form dipole and monopole antenna structures capable of varied polarization directionality. Without loss of generality, in referring to FIGS. 1A and 1B, the inventive method is alternatively implemented by wiring the wings or the horizontal stabilizers as dipoles, the wing-fuselage, the horizontal stabilizer-fuselage or, the vertical stabilizer-fuselage combination as a monopole, and, in the case of aircraft with two vertical stabilizers, the two vertical stabilizer-fuselage combinations as the two-element monopole array.

When operated at the natural resonance frequencies (when the length of the structure forming the antenna is about half or quarter wavelengths for dipoles or monopoles, respectively), the antennas will have near perfect radiation efficiencies depending on the conductivity of the airframe. Each arrangement is illustrated in terms of electrical topography in FIG. 2. In practice, aluminum, steel, carbon-fiber or any other electrically conducting airframes can produce antennas with near perfect efficiencies. Efficiencies will increase as the frequency decreases so, in practice, for example, near perfect efficiencies were recorded with carbon-fiber airframes in HF, VHF and UHF bands depending on the dimensions of the airframe parts. Alternatively, with the help of antenna tuning circuitry, such antenna rearrangements can be operated at frequencies different than their natural resonance frequencies at efficiencies much higher than any other conformal airborne antenna technology.

The present invention realizes conformal airborne antennas with near perfect radiation efficiencies, require minimal cost to implement, add zero weight to the aircraft, cause no extra drag, are conspicuous by revealing no information about the frequency band of the antenna and pose no maintenance hazard. Competing solutions such as paint-on or recessed conformal antennas, which, while having minimal drag and weight, possess poor radiation efficiencies, are maintenance nightmare for aircraft maintenance crews which must take extreme caution when working over or around the airframe surfaces containing the antenna and are very costly to implement. Existing blade antennas cause significant drag, visually broadcast the frequency of operation (evident from the height), require significant modification to the airframe to implement and often offer poor efficiencies over VHF and lower bands as their heights must be limited. By "near perfect" the applicant means an airborne antenna with a radiation efficiency which is within 2 db of an ideal dipole.

Referring to Drawing FIG. 0.1, a typical airframe 214 includes a fuselage 216, left and right main wings 218, left and right horizontal stabilizers 220, one or more vertical stabilizers 222, left and right canards 224, and left and right winglets 226, each of which can be used to form dipole antennas, monopole antennas and arrays of them by selectively electrically isolating some and interconnecting the rest. The aircraft's line of flight is depicted by arrow "Y". The horizontally extending wings 218, stabilizers 220 and canards 224 are depicted by arrow "X". The vertically extending stabilizer 222 is depicted by arrow "Z".

Figure 1B:
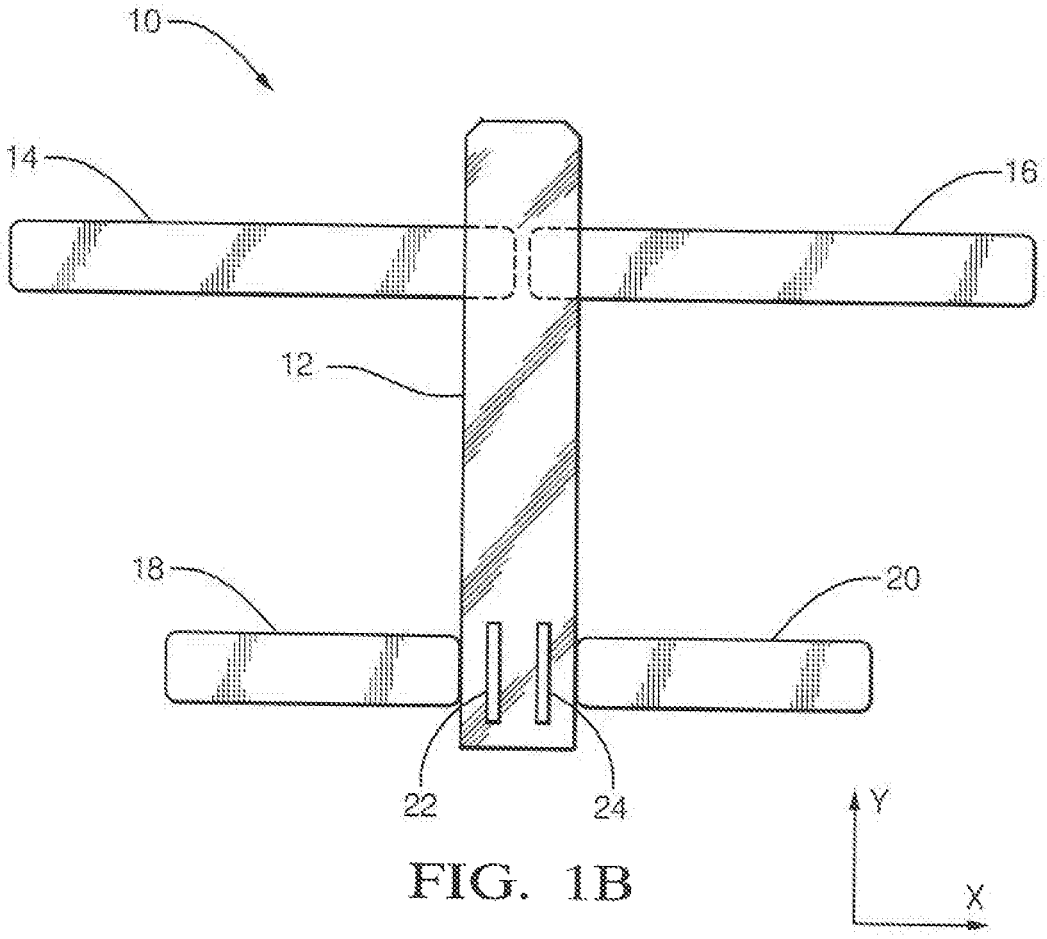
FIG. 1B, is a schematic top plan view of the typical aircraft airframe of FIG. 1A.

Referring to the drawings, and particularly to FIGS. 1A and 1B, views of one embodiment of the invention are illustrated in schematic, front and top plan views. An aircraft 10 comprises a fuselage assembly 12 which is elongated along the "Y" or longitudinal axis and which supports a plurality of airfoil assemblies including an opposed pair of main wings 14, 16, an opposed pair of tail wings or horizontal stabilizers 18, 20, and a spaced apart pair of vertical stabilizers 22, 24. The main wings 14, 16 and horizontal stabilizers 18, 20 are elongated along the "X" or lateral axis. The vertical stabilizers 22, 24 are laterally spaced apart and are elongated along the "Z" axis.

Various movable control surfaces (e.g., ailerons, elevators, tail planes, rudders, leading/trailing edge flaps, winglets, canards and airbrakes/spoilers) are typically integrated within aircraft airfoils to control aircraft attitude, pitch, yaw and roll in flight. The control surfaces themselves are typically controlled directly or indirectly mechanically/hydraulically by a pilot or by servo actuators. For the sake of simplicity, such known devices are not described in detail in the present application.

Referring to FIG. 2, the wiring topology of each antenna type is illustrated in stick figure form including an elongated structural member within each aircraft component assembly. Specifically, the conductive portion of the fuselage is illustrated as an elongated conductive structural member 26 extending along axis Y. The conductive portion of each main wing is illustrated as an elongated conductive structural member 28, 30 extending along axis X. The conductive portion of each horizontal stabilizer is illustrated as an elongated conductive structural member 32, 34 extending along axis X. The conductive portion of each vertical stabilizer is illustrated as an elongated conductive structural member 36, 38 extending along axis Z. Each of the conductive structural members 26-38 are structurally supported by the others in forming the associated aircraft, but are electrically isolated from one another. At least two of the structural members 26-38 form electrical connection points 40, 42 (40', 42') which are electrically interconnected to form a desired antenna configuration.

Figure 3:
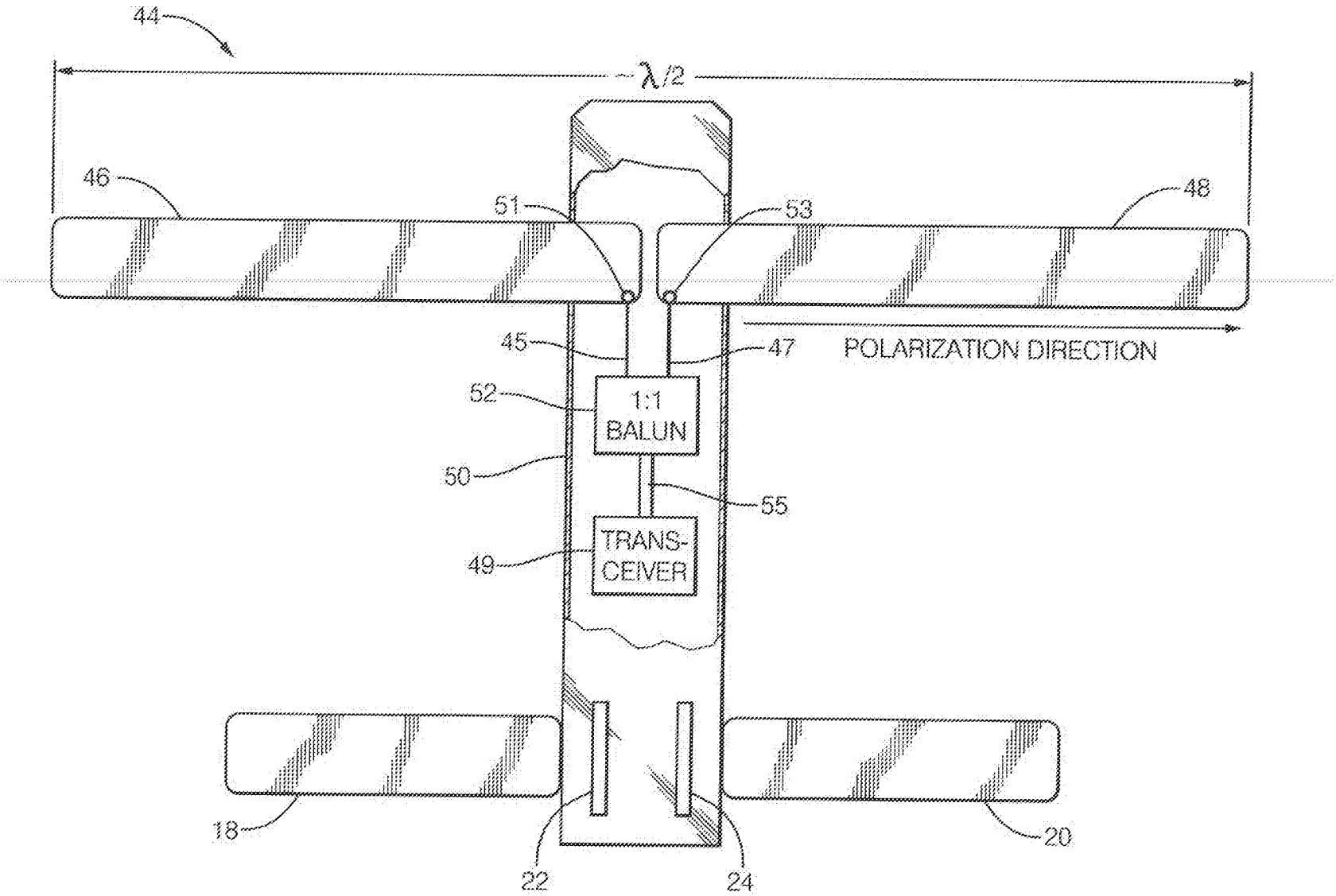
FIG. 3, is a top plan view of the aircraft airframe of FIGS. 1A and 1B configured as a wing dipole antenna.

Referring to FIG. 3, an aircraft 44 configured with a wing dipole antenna uses the front wings 46, 48 as two elements of a dipole antenna. The main wings 46, 48 are electrically isolated from the rest of the aircraft 44, including the fuselage 50, from the horizontal stabilizers 18, 20, the vertical stabilizers 22, 24, and from one another. The antenna is fed using a 1:1 balun 52 with each lead 45, 47 of the balun 52 connected to one of the main wings 46, 48 at attachment points 51, 53. The balun 52 is interconnected to a transceiver 49 (e.g.; transmitter, receiver or combination thereof) via an antenna feed coaxial cable 55. The combined lateral length of the main wings 46, 48 (~$\lambda/2$, where $\lambda$ is the wavelength) determines the primary resonance frequency of the antenna and corresponds to the combined length of the main wings 46, 48 equal to approximately ½ wave length at the frequency of operation.

Figure 4:
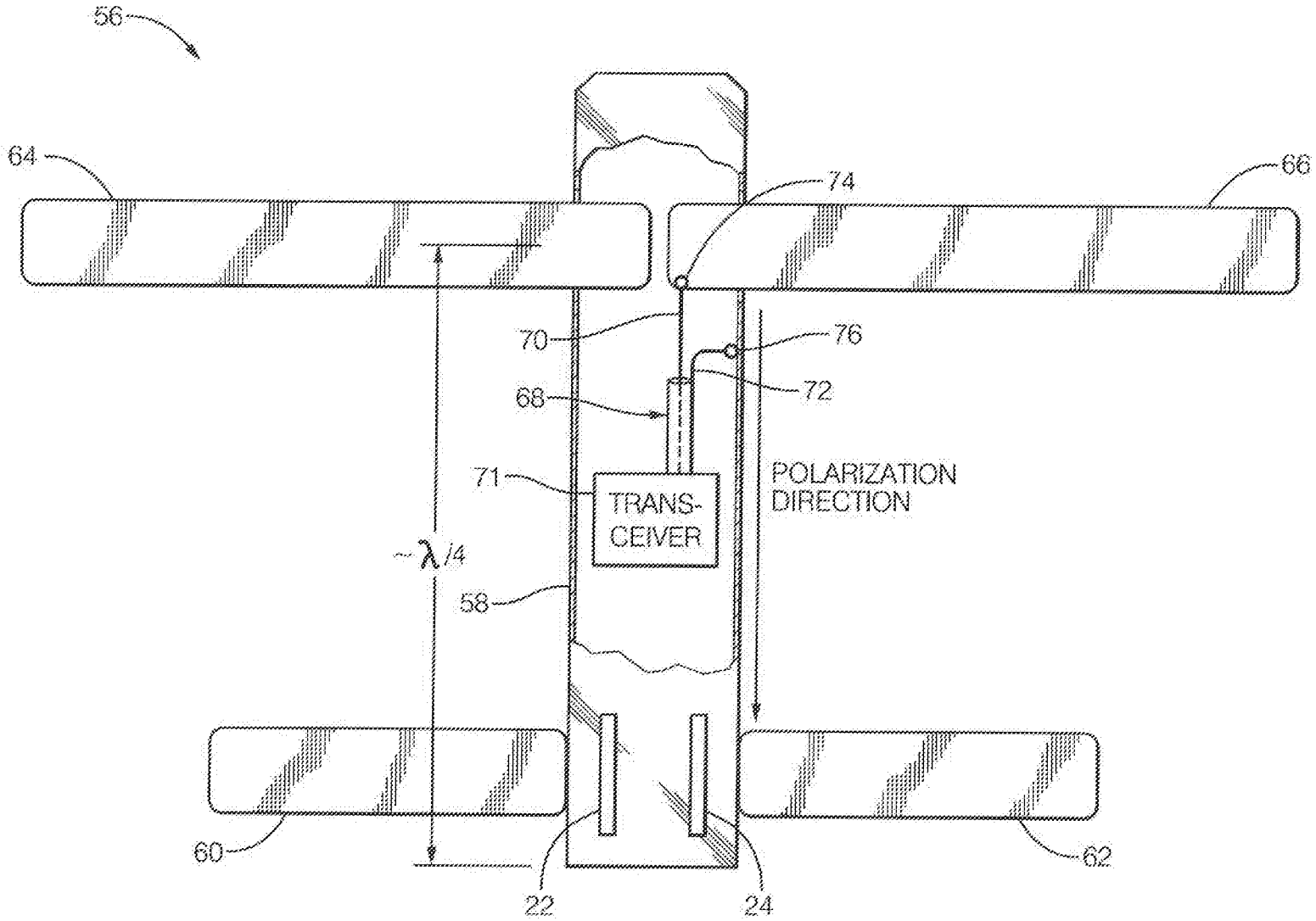
FIG. 4, is a top plan view of the aircraft airframe of FIGS. 1A and 1B configured as a fuselage monopole antenna.

Referring to FIG. 4, in an airplane 56, the fuselage monopole antenna configuration uses the fuselage 58 and horizontal stabilizers 60, 62 as a top-loaded monopole antenna. The front wings 64, 66 are electrically isolated from the rest of the aircraft 56. The fuselage 58 is the radiating element of the antenna and the front wing 66 serves as the ground plane. The horizontal stabilizers 60, 62 of the airplane 56 serve to add a capacitive or conductive load to the top of the antenna element depending on whether they are electrically isolated from or connected to the fuselage, respectively (both cases work). The antenna is fed by attaching the center conductor 70 of a coaxial antenna feed cable 68 extending from a transceiver 71 to one of the front wings 66 at an attachment point 74 and attaching the outer (ground) conductor 72 of the coaxial feed cable 68 to the fuselage 58 at another attachment point 76. Inner and outer conductors of the coaxial cable can be connected in reverse and reversing them does not make a difference in the operation of the antenna. The polarization direction of the antenna extends primarily longitudinally along the fuselage 58 though the polarization purity is not as high as the wing dipole described in FIG. 3. The resonance frequency of the antenna depends on the longitudinal length of the fuselage 58 and the rear wing structure 60, 62, which is close to quarter of a wavelength (~$\lambda/4$).

Referring to FIGS. 3 and 4, the two antenna options, when implemented on a particular UAV, have been observed, in practice, to operate over similar frequency bands with similar gain levels. FIGS. 5A and 58 show the measured variation of Gain and VSWR with frequency for wing dipole and fuselage-wing monopole antennas, respectively, which are implemented on a particular medium size UAV with carbon-fiber airframe. Both antennas are observed to operate in similar frequency bands, namely, 80-110 MHz. It must be noted that the maximum gains are also similar: 2 dBi for the wing dipole and 0.5 dBi for the fuselage-wing monopole. It is evident from this data that both dipole configuration exhibit near perfect radiation efficiency since gain of a perfect dipole is 2.2 dBi. Monopole gain suffers from polarization impurity but is still within 1.5 dB of the dipole. FIGS. 6A2 and 6B2 show the H-pol and V-pol gain patterns at 90 MHz of the wing dipole and the fuselage-wing monopole antennas, respectively. The gain patterns shown in FIGS. 6A2 and 682 are typical of dipole and monopole behavior, respectively, and validate the polarization directions depicted in FIGS. 3 and 4. Patterns also exhibit 10 dB or larger polarization isolation. The gain pattern of FIG. 6A2 is recorded by rotation of a test aircraft 228 about axis Y (referring to FIG. 1B) as indicated by arrow 230. Likewise, the gain pattern of FIG. 6B2 is recorded by rotation of a test aircraft 232 about axis Y (referring to FIG. 1B) as indicated by arrow 234.

Figure 7:
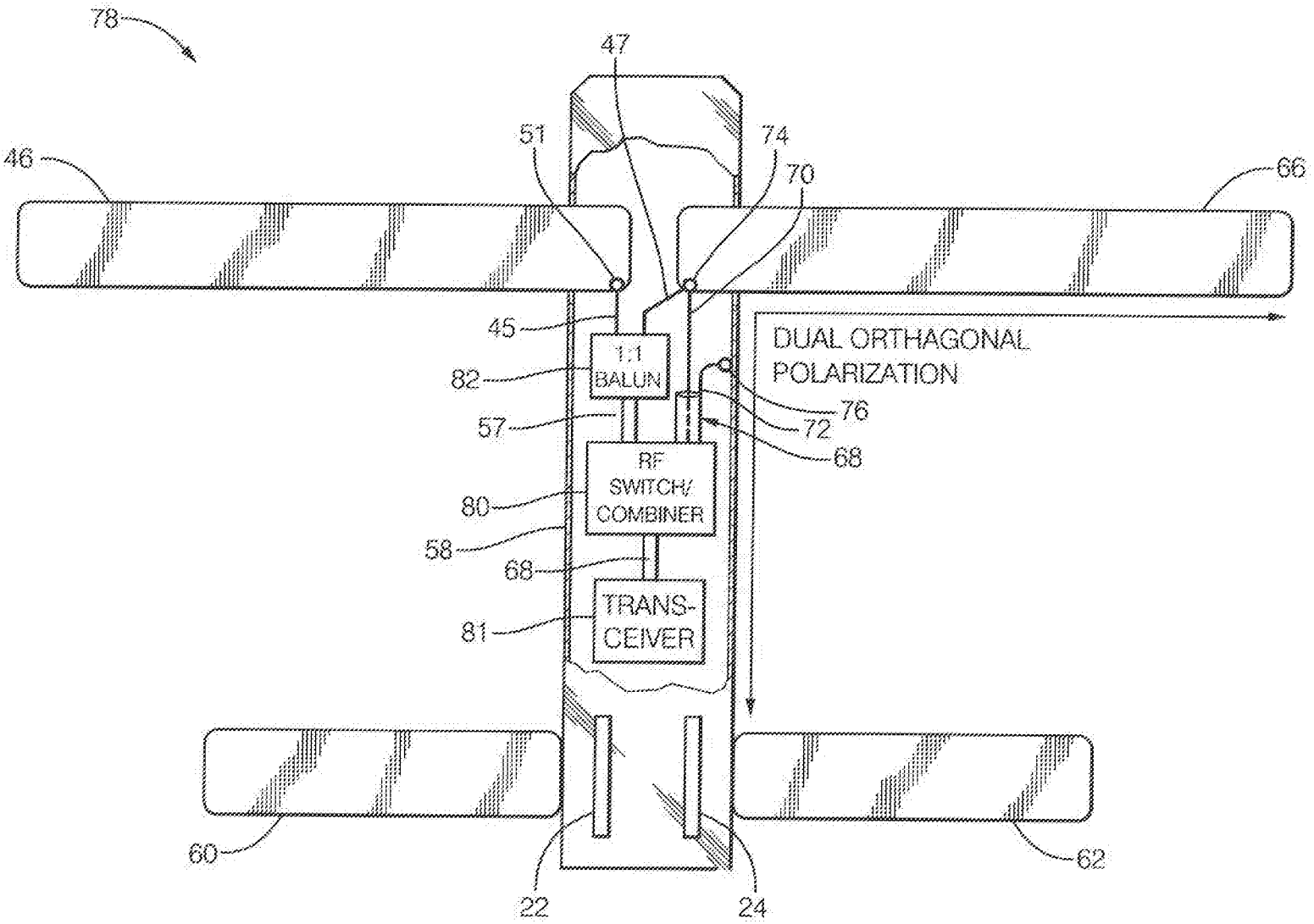
FIG. 7, is a top plan view of the aircraft airframe of FIGS. 1A and 1B configured as a dual orthogonal polarization antenna for polarization diversity applications supporting Multiple-In-Multiple-Out (MIMO) implementation.

Referring to FIGS. 3 and 4, by combining the two antenna options illustrated, an antenna with dual, orthogonal polarizations can be realized as shown in FIG. 7 in an aircraft 78. Switching between either the wing dipole or fuselage-wing monopole antenna configurations with the help of an RF switch 80 would allow for polarization diversity. Switching is accomplished by use of a coax switch/combiner 80 with an input from the coaxial antenna feed cable 68 from a transceiver 81. The coax switch/combiner 80 has two outputs, one feeding the input of a 1:1 balun 82 through a coaxial lead 57 and one feeding the main wing attachment point 74 of the main wing 66 attachment point 74 through the center conductor 70 of a coaxial lead 68. The outer conductor 72 of the coaxial lead 68 is connected to a ground connection point 76 of the fuselage 58. The 1:1 balun 82 has a first output interconnected to the main wing attachment point 51 of the port main wing 46 through a lead 45, and a second output interconnected to the main wing attachment point 74 of the starboard main wing 66 through a lead 47. Considering also the data presented in FIGS. 5A, 5B, 6A and 68, the dual polarization antenna of FIG. 7 can be used effectively to implement polarization diversity or MIMO to double wireless channel capacity since both antennas operate over the same frequency bands, have similar gain levels and possess 10 dB or more polarization isolation.

Figure 8:
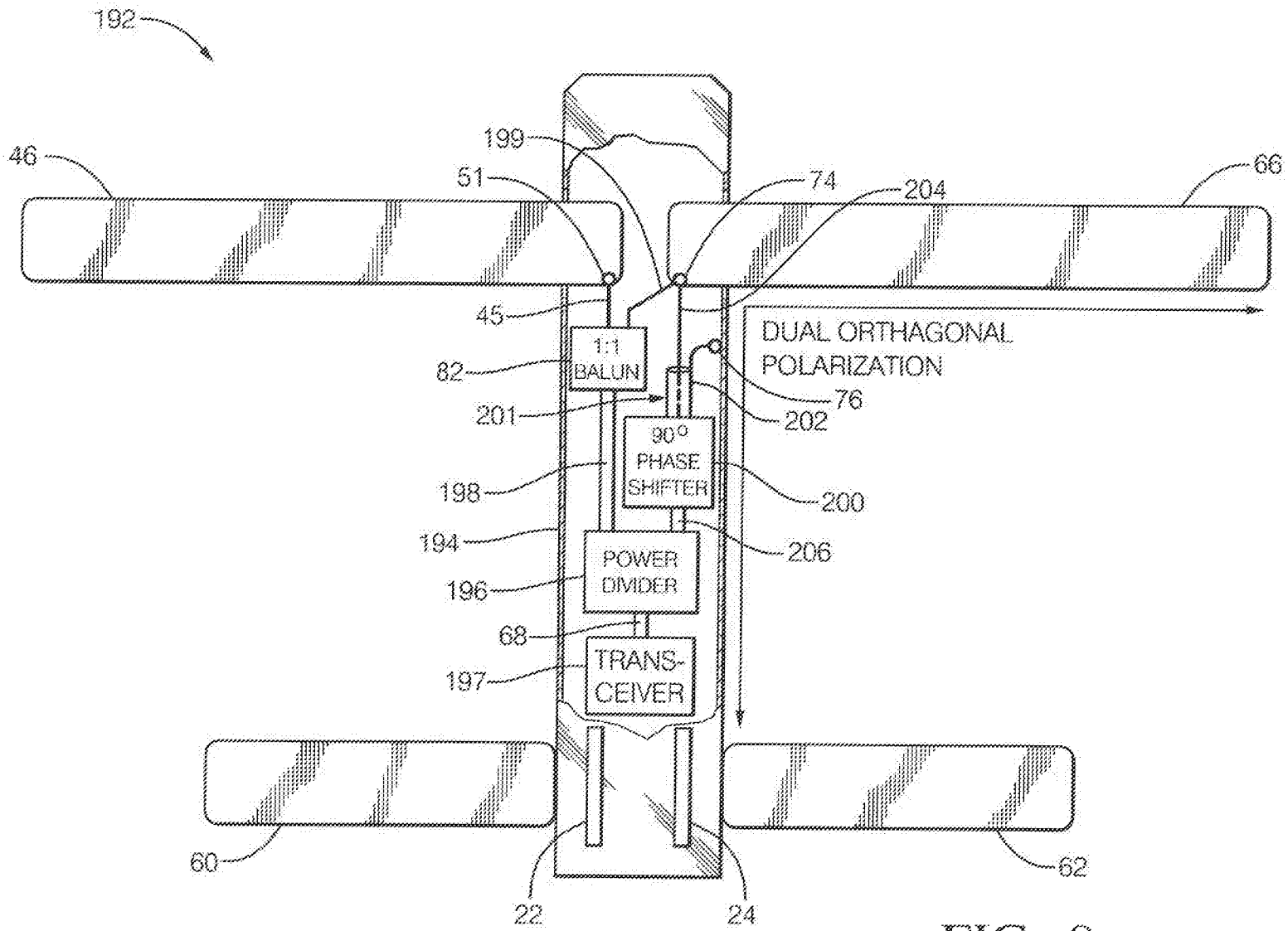
FIG. 8, is a top plan view of the aircraft airframe of FIGS. 1A and 1B configured as a circular polarization antenna variant to that embodied in FIG. 7.

Referring to FIG. 8, an aircraft 192, by combining the two antenna options illustrated in FIGS. 3 and 4, provides a circularly-polarized antenna. The only differences from FIG. 7 are that the RF switch 80 is replaced by a power divider 196 and the monopole antenna feed now contains a 90 degree phase shifter (realized by a section of a coax or a lumped passive circuit) 200. The power divider 80 has two outputs, one feeding the input of a 1:1 balun 82 through a coaxial lead 198 and one feeding the input of a 90° phase shifter 200. One output of the 1:1 balun 82 is interconnected with an attachment port 51 of one main wing 46 by a lead 45. A second output of the 1:1 balun 82 is interconnected with an attachment port 74 of the other main wing 66 by a lead 199. The output of the 90° phase shifter 200 is interconnected with main wing attachment point 74 of the main wing 66 through the center conductor 204 of a coaxial lead 201. The outer conductor 202 of the coaxial lead 201 is connected to a ground connection point 76 of the fuselage 194. Both sections of the main wing 46 and 46 are otherwise electrically isolated from each other and from the fuselage. Circularly polarized antennas have been shown to be effective in improving wireless link quality in environments that experience polarization reversal or polarization rotation, urban areas, non-line-of-sight scenarios, environments with a lot of foliage and obstacles, and any communication that involves reflections from and propagation through the ionosphere. In addition, all satellite-based communications require circularly polarized antennas including CPS, Satellite Radio and TV, and many military communications due to polarization rotation caused by ionosphere.

Figure 9:
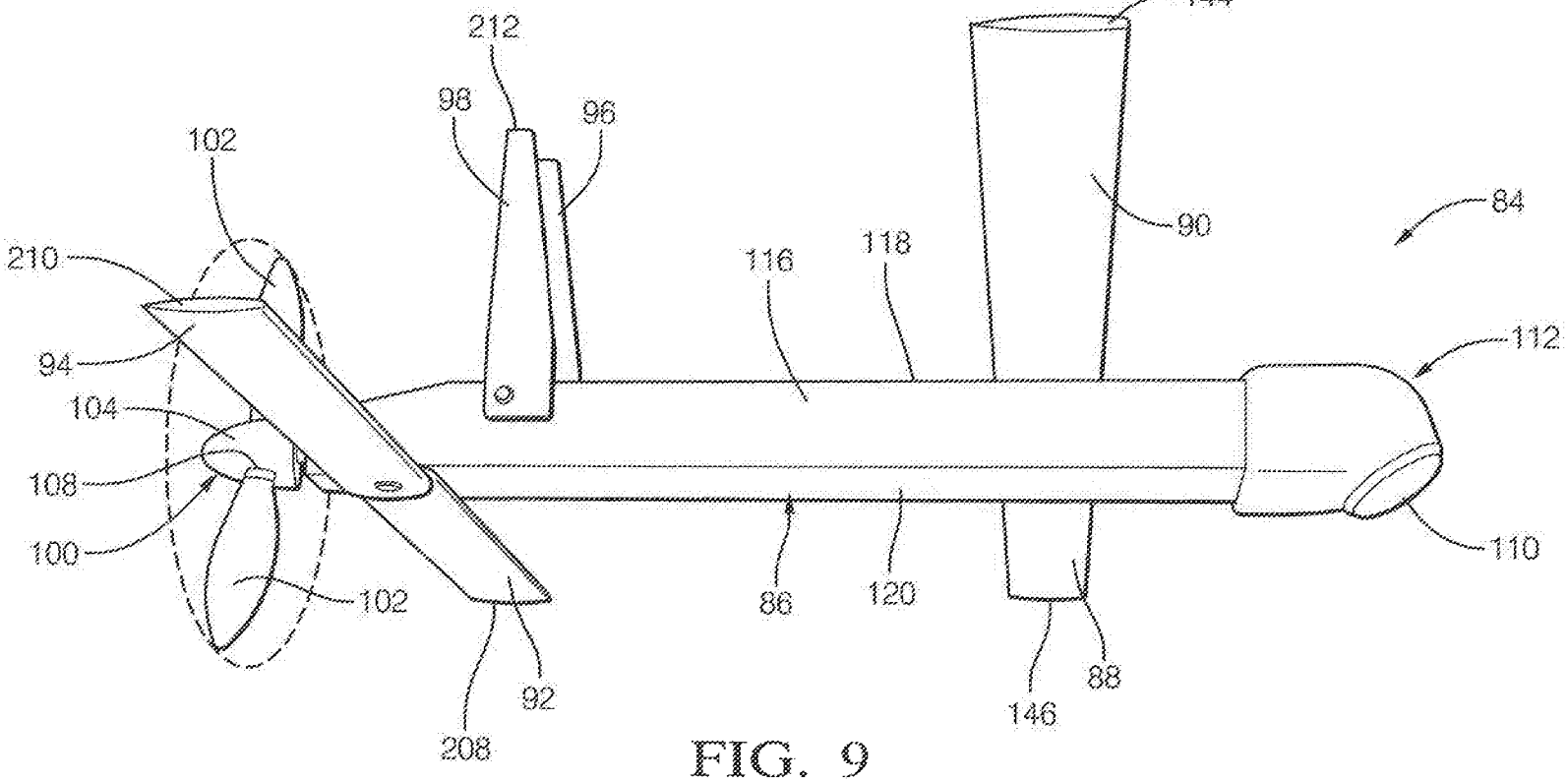
FIG. 9, is a perspective view of one embodiment of the present invention with all aircraft airfoils (wings, vertical stabilizers, and horizontal stabilizers) and propeller in a flight deployed orientation.
Figure 10:
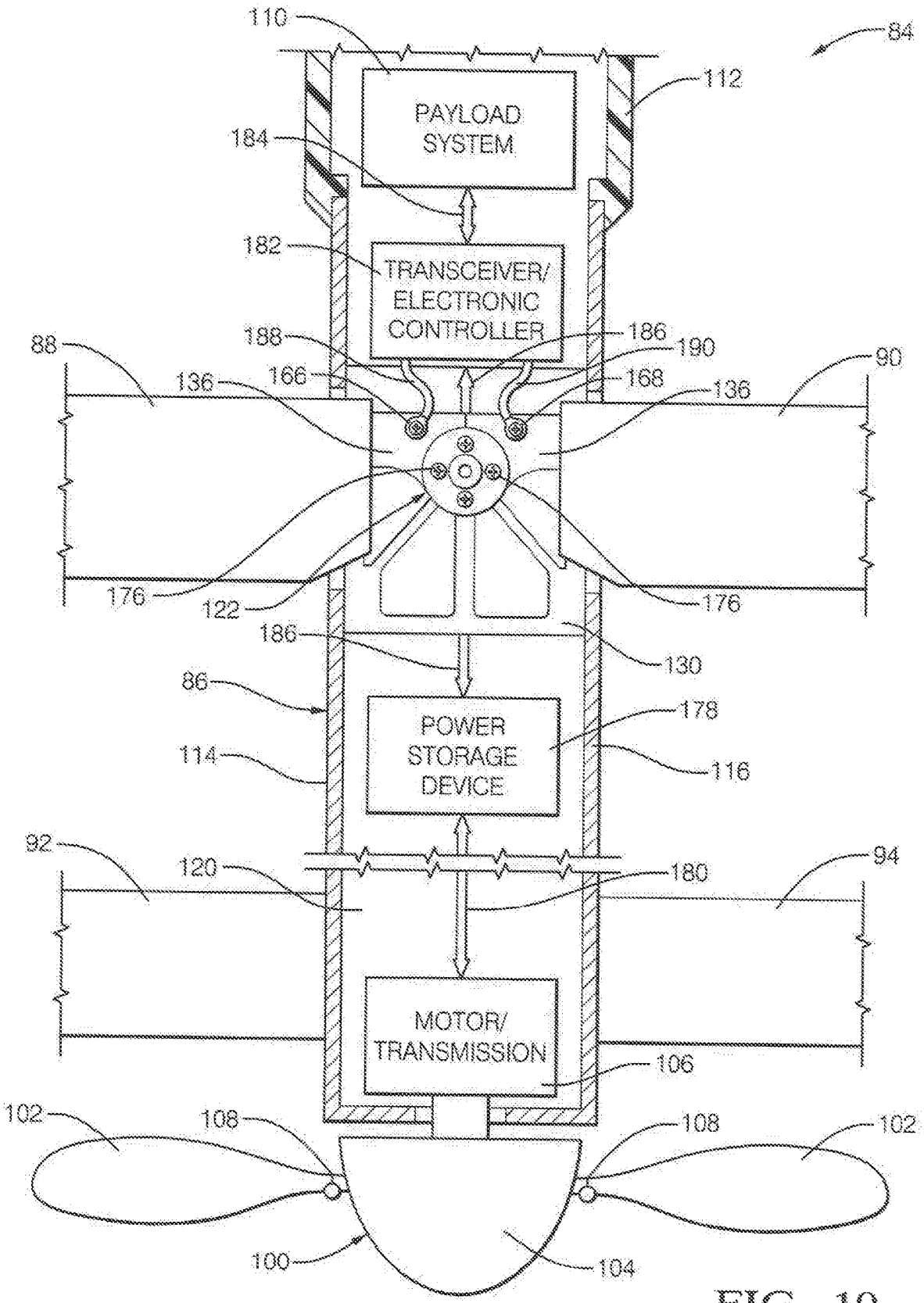
FIG. 10, is a broken, cross-sectional view of the present invention of FIG. 9 illustrating the major internal components and subsystems of the aircraft.

Referring to FIGS. 9 and 10, an embodiment of the present invention can be implemented in a pilotless drone-type aircraft (i.e. a UAV) 84 comprising an elongated fuselage 86, an opposed pair of front wings 88, 90, an opposed pair of horizontal stabilizers 92, 94, and an opposed pair of vertical stabilizers 96, 98, collectively referred to as airfoil assemblies. The airfoil assemblies are attached to the fuselage 86 for in-flight positions illustrated in FIGS. 9 and 10. The aircraft 84 further includes a "pusher" propeller system 100 within its empennage including a plurality of blades 102 and a rotating hub 104 driven by a motor/transmission system 106. The blades 102 are interconnected to the hub 104 by hinges 108. The aircraft 84 further includes a front payload system 110 suitable for navigation, surveillance and the like, disposed within a nose cone 112.

Each airfoil assembly (e.g., front wings 88, 90, horizontal stabilizers 92, 94, and vertical stabilizers 96, 98) is pivotally mechanically affixed to the fuselage 86. Furthermore, each airfoil assembly (e.g., front wings 88, 90, horizontal stabilizers 92, 94, and vertical stabilizers 96, 98) is electrically isolated from one another as well as the fuselage 86 to enable selective coupling in varying combinations to effect varied antenna configurations.

In the embodiment of FIGS. 9 and 10, the fuselage 86 is formed of rectangular aluminum (e.g., electrically conductive) structure including left (port), right (starboard), top and bottom integrated side members 114, 116, 118 and 120, respectively. Thus, the fuselage 86 can be employed in its entirety as an elongated structural member as an element of the antenna. Similarly, each airfoil assembly is formed of an elongated aluminum spar (i.e., electrically conductive) covered with an aerodynamically shaped (carbon-fiber composite) skin (i.e., electrically conductive). Thus, each airfoil assembly (wings 88, 90 and stabilizers 92, 94, 96 and 98) can be employed in its entirety as an elongated structural member as a second element of the antenna. Because the fuselage 86 and airfoil assemblies (wings 88, 90 and stabilizers 92, 94, 96 and 98) collectively form the entire airframe, no net weight is added to the aircraft 84 to integrate the antenna and hence, the "zero-weight assertion.

Attachment of each airfoil to the fuselage 86 is accomplished by an electrically insulating pivot assembly 122 employing a pivot shaft, a top cap and a number of washers and shims, all of which are made of non-conductive materials.

Each front wing 88, 90 consists of elongated electrically conductive (metal) spar 136 interference fit within a through passage formed by an aerodynamically shaped conductive (carbon-fiber composite) skin. The spars transition into a pair of concentric annular bushings containing antenna wire connection points 166 and 168.

Thus assembled, the pivot assembly 122 serves to mechanically support the wings 88, 90 to the fuselage, while simultaneously continuously electrically insulating the wings 88, 90 from one another and the fuselage 86. As illustrated in FIG. 10, the pivot assembly 122 is suitably affixed to the fuselage 86, such as with threaded fasteners 176 while preserving the above-stated electrical isolation. Finally, electrically insulating latches (not illustrated) are provided to maintain the airfoil assemblies in their respective flight positions of FIG. 9.

Referring to FIGS. 9 and 10, the outward most end tips of each airfoil 88, 90, 92, 94, 96 and 98 are closed by an end cap formed of electrically conductive carbon-fiber composite material. The main wings 88 and 90 include end caps 144 and 146, respectively. The horizontal stabilizers 92 and 94 include end caps 208 and 210, respectively. The vertical stabilizers 96 and 98 include end caps 212 (only one illustrated). The end tips serve to provide a tip end shape for each airfoil, as well as providing water-tight hermetic sealing of each respective airfoil.

Referring to FIG. 10, a propulsion system is disposed within the fuselage 86, including electric motor/transmission assembly 106 powered by a power storage device 178 (e.g., battery) to drive the propeller system 100 via electrical cables 180. Furthermore, a reconnaissance/communication/control system is disposed within the fuselage 86, including an electronic controller/computer 182 including a microprocessor and memory. The controller 182 is interconnected with the aircraft payload system 110 by cables 184 and with the power storage device 178 by cables 186. The transceiver (transmitter/receiver) portion of the controller 182 is interconnected with each airfoil assembly and/or fuselage 86 forming a portion of the aircraft antenna system by flexible wires 188, 190 through wire connector ports 166, 168. It must be noted that the particular connections between the transceiver 182 and the front wings through the wires 188, 190 described above depict specifically the realization of the wing-dipole arrangement of FIG. 3 and is provided here as an example of how the wiring is accomplished. Similar wiring is carried out to realize the other antenna arrangements described in this invention.

The results and advantages of the present invention consists of:

- Conformal and zero-weight antennas. Antenna integration does not change aerodynamics or significantly affect the structural integrity of the aircraft.
- Antenna with near-perfect radiation efficiency, very close to that of a half-wave dipole antenna at the same frequency of operation.

Allows for antennas to be integrated into the aircraft operating at significantly lower frequencies and significantly higher efficiencies than competing conformal solutions.

Can provide antennas with orthogonal polarizations for polarization diversity and MIMO or for transmission and reception of circular polarization without loss of radiation efficiency for increasing wireless channel capacity.

Zero Weight Antenna for Aircraft Utilizing Airframe—Rotary Wing Aircraft.

The integration of wide-band high efficiency antennas into airframes especially at low frequencies is very difficult for two reasons: (1) such antennas need to be large and cannot be protruding out of the airframe, and (2) because most airframes are electrically conductive (aluminum or carbon fiber), conformal antenna printed on such surfaces have narrow bandwidth and low efficiency. The invention disclosed here is a continuation-in-part of the parent application, extending the airframe antenna to various rotary wing aircraft such as manned helicopters, drones and unmanned autonomous helicopters.

Illustrative examples of utilizing the airframe for zero weight, high efficiency antennas on a rotary wing aircraft are shown in alternative embodiments described herein below.

Figure 11:
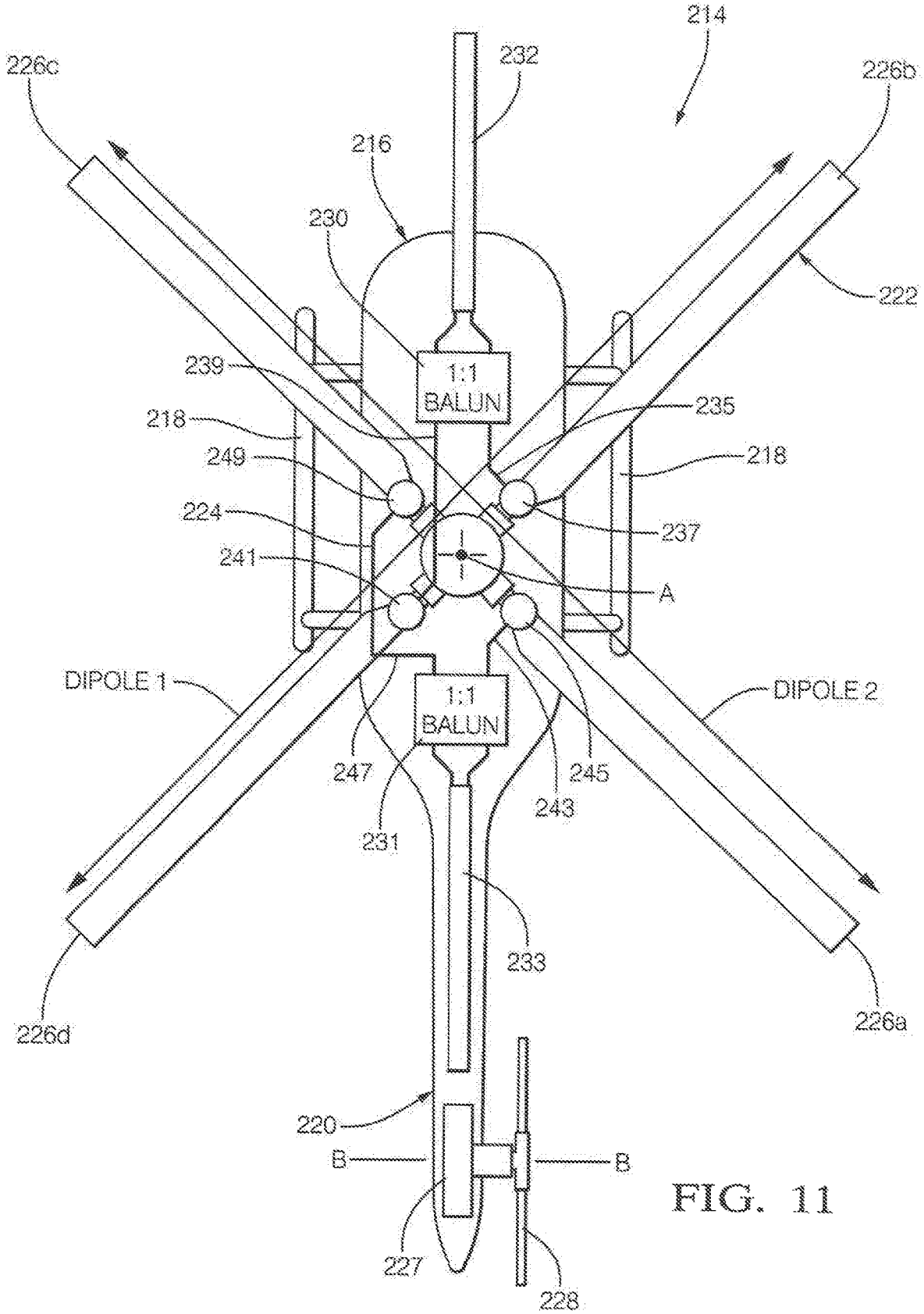
FIG. 11, is a top plan view of a rotary wing aircraft dipole antenna configuration using opposite blades of the rotary wing on the aircraft as two elements of a dipole antenna.

Referring to FIG. 11, a conventional, manned helicopter 214 includes an elongated fuselage 216 forming a passenger cabin, a rotor propulsion system and various electronic drive, control and communication systems. An opposed pair of longitudinally directed landing skids 218 extend laterally from and below the fuselage 216. The fuselage 216 forms a longitudinally rearwardly extending tail section 220. A main rotor assembly 222 comprises a driven hub 224 supporting four symmetrically arranged outwardly directed wing blades 226*a*, 226*b*, 226*c* and 226*d* for rotation about a vertical axis A, wherein wing blades 226*a* and 226*c* are aligned and wing blades 226*b* and 226*d* are aligned to form dipole 1 and dipole 2, respectively.

A tail rotor 228 is affixed to a boom 227 extending above the longitudinal distal end of the tail section 220. The tail rotor rotates about a horizontal axis B.

The rotary wing dipole antenna configuration uses opposite blades 226 of the rotary wing on the aircraft 214 as two elements of a dipole antenna as shown in FIG. 11. The blades of the rotary wings 226 are electrically isolated from each other and from the body 216 of the aircraft 214. The antenna is fed using two 1:1 baluns 230 and 331, each fed by a coaxial feed cable 232 and 233, respectively. A first line 235 from 1:1 balun 230 connects to an attachment point 237 on blade 226*b* and a second line 239 connects to an attachment point 241 on blade 226*d*. A first line 243 from 1:1 balun 231 connects to an attachment point 245 on blade 226*a* and a second line 247 connects to an attachment point 249 on blade 226*c*.

A coaxial rotary joint (not illustrated) electrically interconnecting the relatively fixed 1:1 baluns 230 and 231 is widely known in the art and is not described herein for the sake of brevity.

The combined length of a pair of rotary wing blades 226 fed by the coaxial cable 232 determines the primary resonance frequency of the antenna, and the polarization of the antenna is along the rotary blades 226 being fed. The rotary wing dipole antenna configuration illustrated in FIG. 11 produces two dipole antennas with perpendicular polarization. This arrangement also allows for circular polarization if one pair is phased 90 degrees with respect to the other and the two coax leads 232 and 233 are combined.

Figure 12:
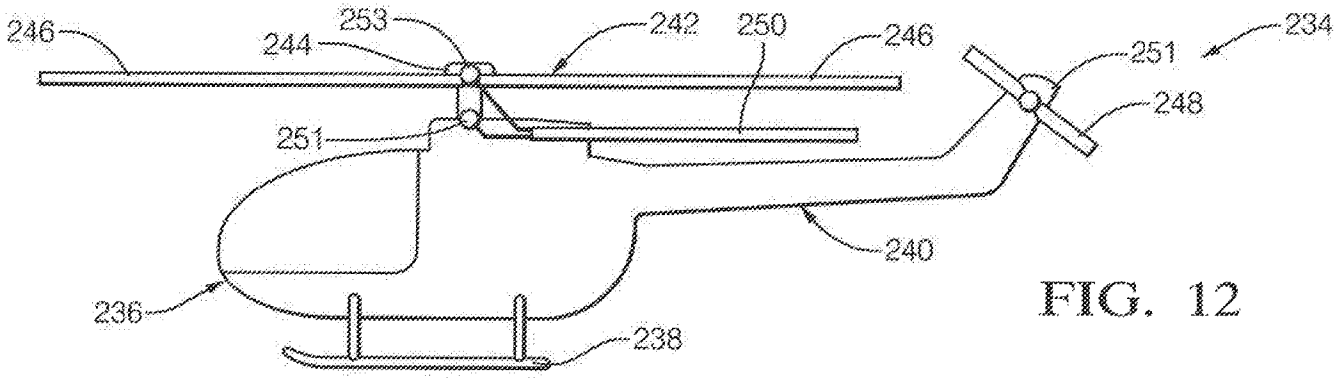
FIG. 12, is a side plan view of a top loaded monopole antenna configuration using the body and the rotary wing of the aircraft to form the antenna, wherein the rotary wing is electrically isolated from the rest of the aircraft and the antenna is fed by connecting the ground of a coaxial cable to the aircraft body and the center conductor to the rotary wing.

Referring to FIG. 12, a conventional, manned helicopter 234 includes an elongated fuselage 236 forming a passenger cabin, a rotor propulsion system and various electronic drive, control and communication systems. An opposed pair of longitudinally directed landing skids 238 extend laterally from and below the fuselage 236. The fuselage 236 forms a longitudinally rearwardly extending tail section 240. A main rotor assembly 242 comprises a driven hub 244 supporting four symmetrically arranged outwardly directed wing blades 246 which are electrically interconnected with one another but are electrically insulated from the fuselage 236.

A tail rotor 248 is rotationally affixed to a boom 251 extending above the longitudinal distal end of the tail section 240.

The top loaded monopole antenna configuration employs the fuselage 236 and the rotary wing 246 of the aircraft 234 to form an antenna. The rotary wing 246 is electrically isolated from the rest of the aircraft 234 and the antenna is fed by connecting the ground of a coaxial cable 250 to a connection point 251 on the aircraft body 234 and the center conductor to a connection point 253 on the rotary wing 246 through a rotary interface (not illustrated). Each blade 264 in a pair could be shorted together, each blade 264 of both blades could be shorted together, or all individual blades 264 could be shorted together.

Figure 13:
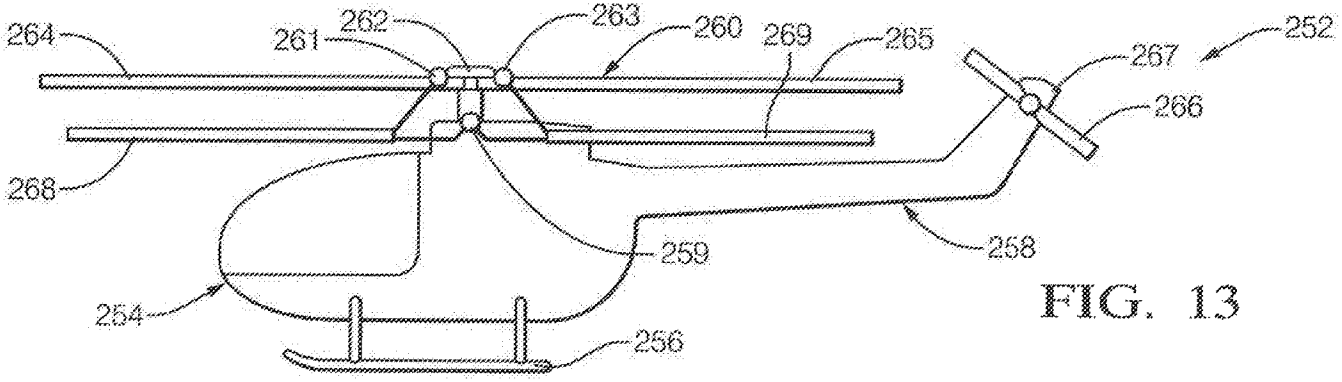
FIG. 13, is a side plan view of a top loaded monopole antenna configuration using the body and the rotary wing of the aircraft to form the antenna, wherein each blade in a pair can be shorted together, or each of both blades can be shorted together, or all individual blades can be shorter together. In a variant, arrangement, each blade can be isolated from each other to form arrays of monopoles.

Referring to FIG. 13, a conventional, manned helicopter 252 includes an elongated fuselage 254 forming a passenger cabin, a rotor propulsion system and various electronic drive, control and communication systems. An opposed pair of longitudinally directed landing skids 254 extend laterally from and below the fuselage 254. The fuselage 254 forms a longitudinally rearwardly extending tail section 258. A main rotor assembly 260 comprises a driven hub 262 supporting four symmetrically arranged outwardly directed wing blades 264 which are electrically insulated from one another and the fuselage 254. Two coax feed cables 268 and 269 have their inner conductors separately connected to opposed of the isolated wing blades 264 and 265 through a rotary interface (not illustrated) to respective connection points 261 and 263 through, and their outer conductors commonly connected to the fuselage 254 to connection point 259 on the aircraft body 254.

A tail rotor 266 is rotationally affixed to a boom 267 extending above the longitudinal distal end of the tail section 258. In a variant arrangement, each blade 264 and 265 could be isolated from each other to form arrays of monopoles as illustrated in FIG. 13.

Figure 14:
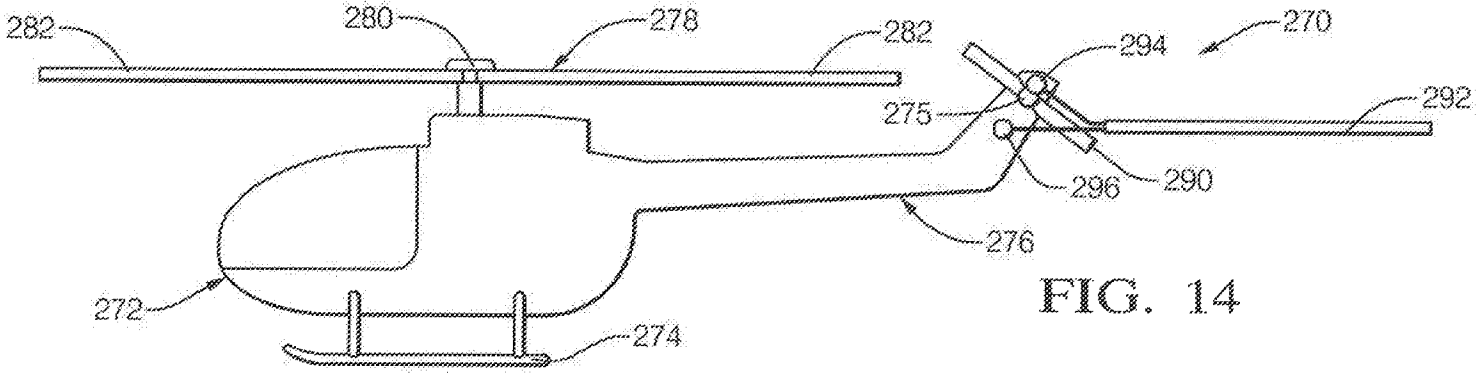
FIG. 14, is a side plan view of a tail rotor antenna configuration using the tail rotor and the aircraft body to create a monopole antenna, wherein the antenna is fed by attaching the center conductor of the coaxial antenna feed cable to the tail rotor and attaching the ground of the coaxial feed to the body of the aircraft.

Referring to FIG. 14, a conventional, manned helicopter 270 includes an elongated fuselage 272 forming a passenger cabin, a rotor propulsion system and various electronic drive, control and communication systems. An opposed pair of longitudinally directed landing skids 274 extend laterally from and below the fuselage 272. The fuselage 272 forms a longitudinally rearwardly extending tail section 276. A main rotor assembly 278 comprises a driven hub 280 supporting four symmetrically arranged outwardly directed wing blades 282 which are electrically interconnected with one another but are electrically insulated from the fuselage 272.

A tail rotor 290 is rotationally affixed to a boom 275 extending above the longitudinal distal end of the tail section 276. A coaxial feed cable 292 has its inner conductor electrically connected to the tail rotor 290 through a rotary interface (not illustrated) to connection point 294 through, and the outer conductor connected to the fuselage 254 to a connection point 296 on the boom 275 of the aircraft body 272.

The concepts described regarding FIGS. 11-14 extend to the implementation of zero weight, high efficiency airframe antennas to rotary wing aircraft.

Zero Weight Antenna for Aircraft Utilizing Airframe—Directional Yagi Configuration.

The integration of wide-band high efficiency antennas into airframes, especially at low frequencies is very difficult for two reasons: (1) Such antenna need to be large and cannot be protruding out of the airframe, and (2) because most airframes are electrically conductive (aluminum and carbon fiber), conventional antenna printed on such surfaces have narrow bandwidth and low efficiency. The invention disclosed here is a continuation-in-part of the parent application, to provide a method for increasing the gain of the integrated airframe antenna by utilizing both the front and back wings of the aircraft.

Figure 15:
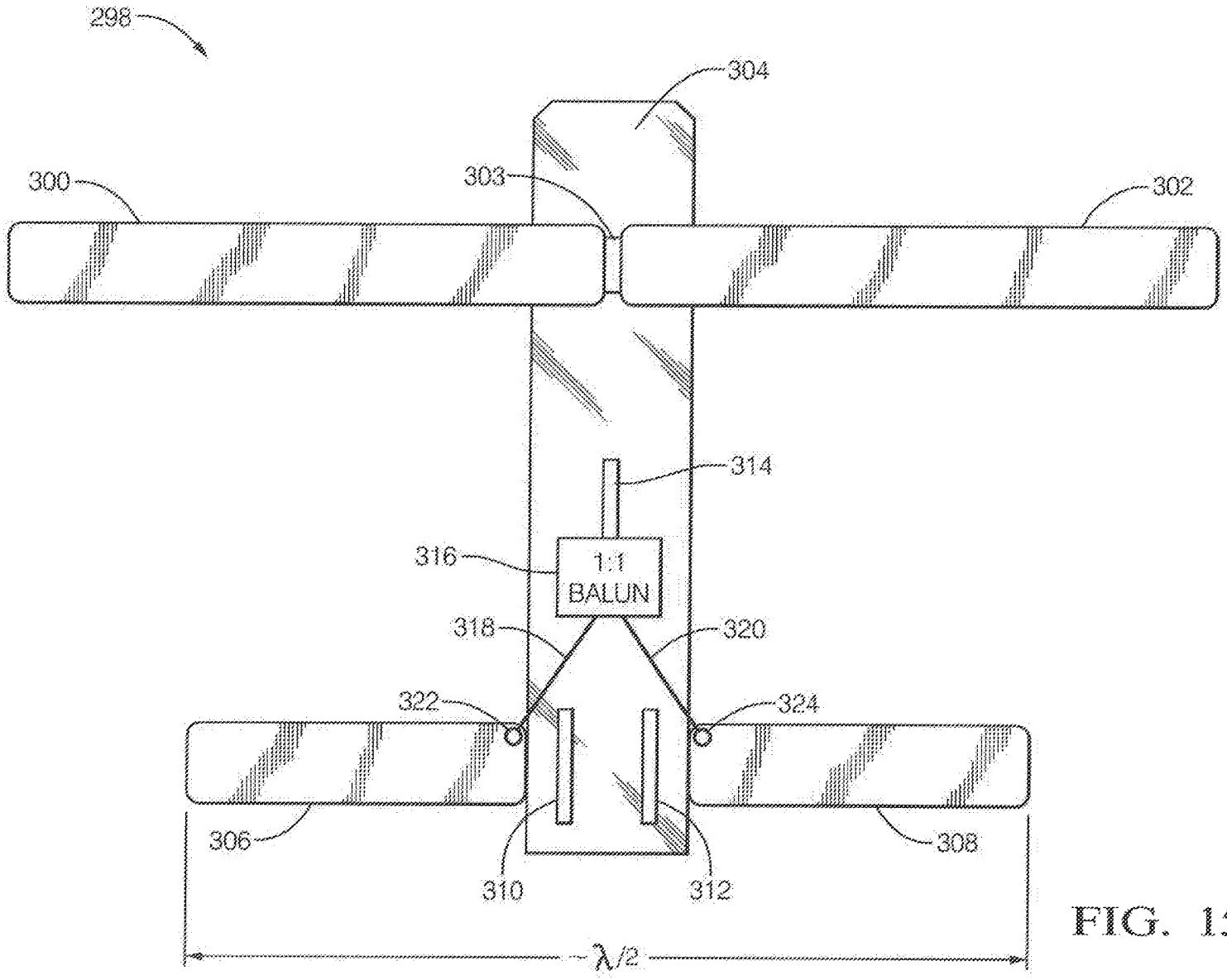
FIG. 15, is a top plan view of a typical aircraft employing the horizontal stabilizers and front wings as two elements of a directional Yagi antenna wherein the horizontal stabilizers are electrically isolated from the fuselage and each other configured as the driven element and the front wings are electrically connected to each other but isolated from the fuselage serving as the reflector.

Referring to FIG. 15, the present invention employs using the back and front wings of an aircraft 298 as two elements of a directional Yagi antenna. The aircraft 298 employs its front or main wings 300, 302 as a reflector element. The main wings 300, 302 are electrically interconnected to one another via a conductive bridge 303 but are electrically isolated from the aircraft fuselage 304. The horizontal stabilizers 306 and 308 comprise a driven element. The horizontal stabilizers 306 and 308 are electrically isolated from one another as well as the aircraft fuselage 304. An antenna feed cable 314 connects to a 1:1 balun 316 with each lead 318 and 320 of the balun 52 connected to one of the horizontal stabilizers 306 and 308 at attachment points 322 and 324, respectively. The balun 316 is interconnected to a transceiver (e.g.; transmitter, receiver or combination thereof) via the antenna feed coaxial cable 314. The combined lateral length of the horizontal stabilizers 306 and 308 is ~$\lambda/2$, where $\lambda$ is the wavelength, which determines the primary resonance frequency of the antenna.

The Yagi antenna configuration described herein can provide a peak gain of up to 5 dBi in the path of the flight of the aircraft 298 with the main beam pointing opposite the direction of flight. Alternatively, flipping the arrangements between the front (main) wings and the horizontal stabilizers will point the main beam in the direction of flight. In comparison, the Dipole and Monopole Configurations described elsewhere in this application have been found to provide 2 dBi and 0.5 dBi gains, respectively. The increase in gain translates to 50% increase in communication range. By utilizing the telescoping extension of the cylinders 326, 328, 330 and 332, the operating frequency of the Yagi antenna can be tuned to any arbitrary frequency.

Zero Weight Antenna for Aircraft Utilizing Airframe—Low Frequency Modification Using Telescopic Extensions The integration of wide-band high efficiency antennas into airframes, especially at low frequencies is very difficult for two reasons: (1) Such antenna need to be large and cannot be protruding out of the airframe, and (2) because most airframes are electrically conductive (aluminum and carbon fiber), conformal antenna printed on such surfaces have narrow bandwidth and low efficiency. The invention disclosed here is a continuation-in-part of the parent application, to provide for lowering the operational frequency of the integrated airborne antenna without compromising its radiation efficiency by dynamically altering the dimensions of the airframe during flight.

The present invention expands upon the invention of the parent application by adding thin and light-weight telescoping cylinders to the ends of the parts of the airframe used to form dipoles and monopole antennas to lower the frequency of operation of the antennas below what is achievable by using only the airframe itself. Additionally, by using motorized or hydraulic telescoping cylinders, the frequency of operation of the airframe antennas can be dramatically changed during flight. Also, this part of the invention is a method of using sections of the airframe as a monopole or dipole antenna even if the front or back wings of the aircraft cannot be electrically isolated from each other or the rest of the aircraft and, hence, it is applicable to large aircraft also. The following sub-sections describe the possible arrangements with the Extended Dipole Configurations being applicable to small UAV's and the Wing Monopole Configuration being more applicable to larger aircraft.

Extended Wing Dipole Antenna Configuration

Figure 16:
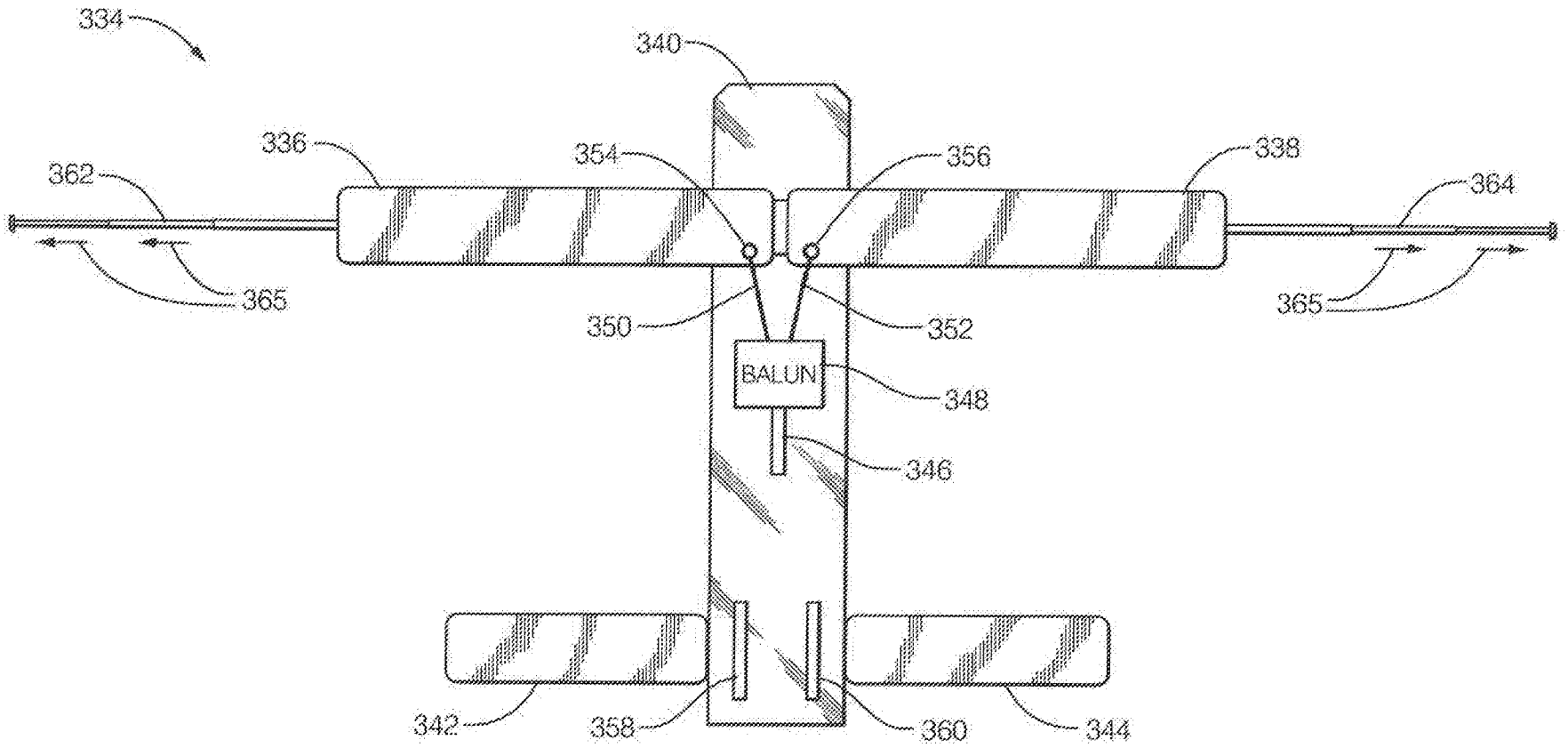
FIG. 16, is a top plan view of the aircraft airframe of FIGS. 1A and 1B configured as a wing dipole antenna which can be tuned by electrically connecting telescoping cylinders to the ends of the front wings.

The wing dipole antenna configuration uses the front wings of the aircraft as two elements of a dipole antenna with electrically conducting telescoping cylinders electrically connected to the ends of the front wings as shown in FIG. 16. The front wings are electrically isolated from the rest of the aircraft body and from each other. The antenna is fed using a balun with each lead of the bauln connected to one of the front wings. The combined length of the front wings plus the length of the telescoping cylinders determines the primary resonance frequency of the antenna and corresponds to the total length of the front wings plus the length of the telescoping cylinders equal to approximately one-half wavelength at the frequency of operation. The frequency of operation of the antenna can be changed dramatically during flight by mechanically extending or retracting the telescoping cylinder symmetrically at the end of each wing. Telescoping cylinders can be attached to the horizontal stabilizers to form a dipole antenna in a similar manner to the front wings.

Referring to FIG. 16, the present invention employs using the front wings 336 and 338 of a small UAV aircraft 334 as two elements of a dipole antenna, whose length is dynamically adjusted through the telescoping extensions 362 and 364, which are electrically connected to the ends of the front wings 336 and 338, respectively. The front wings 336, 338 are electrically isolated from one another as well as the aircraft fuselage 340. The horizontal stabilizers 342 and 344 extend horizontally and two vertical stabilizers 358 and 360 extend vertically away from the fuselage 340. An antenna feed cable 346 connects to a balun 348 with each lead 350 and 352 of the balun 348 connected to one of the front wings 336 and 338 at attachment points 354 and 356, respectively. The balun 348 is interconnected to a transceiver (e.g.; transmitter, receiver or combination thereof) via the antenna feed coaxial cable 346. Electrically connecting adjustable telescoping cylinders 362 and 364 extend from the outer ends of the front wings 336 and 338, respectively. Extension and collapsing of the telescopic cylinders 362 and 364 dynamically adjusts the operating frequency of the antenna. The same arrangement can be implemented using the horizontal stabilizers 342 and 344 to cover a different frequency band.

Extended Wing Monopole Antenna Configuration

The wing monopole antenna configuration uses the front wings and telescoping cylinders to create monopole antennas. The telescoping cylinders may or may not be electrically isolated from the front wings, and the front wings are electrically connected to each other but may or may not be electrically connected to the rest of the aircraft. The telescoping cylinder is the radiating element of the antenna and the front wings (including the aircraft body if electrically connected) is used as the ground plane. The antenna is fed by attaching the center conductor of the coaxial antenna feed cable to one of the telescoping cylinders and attaching the ground of the coaxial feed to the edge of the front wing. An impedance matching balun may or may not be needed at the feed point. The resonance frequency of the antennas depends on the length of the telescoping cylinder, and the frequency of operation of the antenna can be changed dynamically during flight by mechanically extending or retracting the telescoping cylinder at the end of either wing. The operation frequency of the antenna on either front wing can be varied independently from each other.

Figure 17:
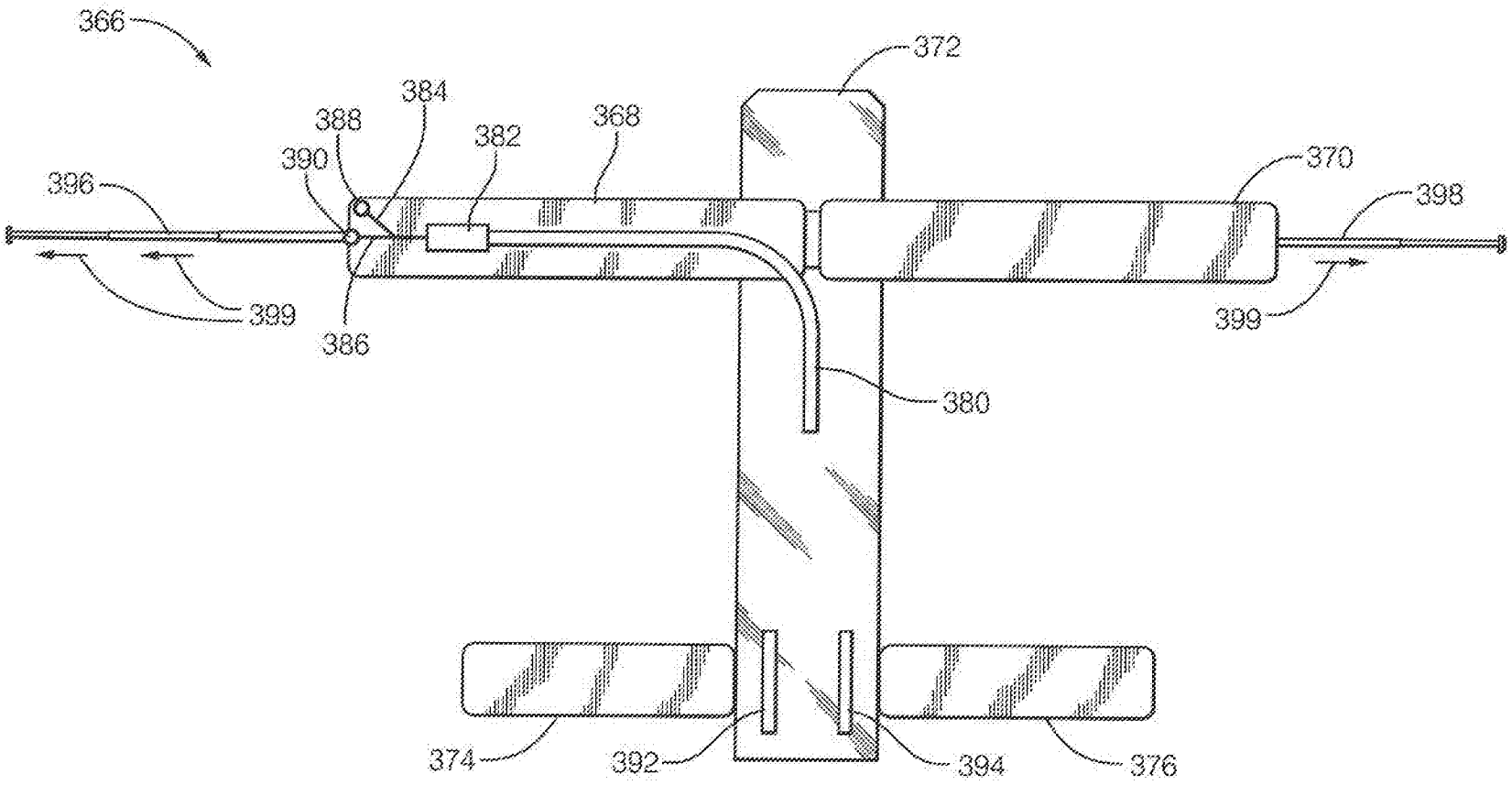
FIG. 17, is a top plan view of the aircraft airframe of FIGS. 1A and 1B configured as an alternative wing monopole antenna which can be tuned by insulatively or electrically connecting telescoping cylinders to the ends of the front wings.

Referring to FIG. 17, the present invention employs the front wings 368 and 370, which are electrically interconnected to one another but may or may not be electrically connected to the aircraft fuselage 372. An antenna feed cable 380 connects to a matching circuit balun 382 (whose presence may not be required) embedded within the left front wing 368 with each lead 384 and 386 of the matching circuit balun 382 connected to the left front wing 368 at an attachment point 388 and the telescoping cylinder 396 at the attachment point 390, respectively. The matching circuit balun 382 is interconnected to a transceiver (e.g.: transmitter, receiver or combination thereof) via the antenna feed coaxial cable 380. The horizontal stabilizers 374 and 376 extend horizontally away from the fuselage 372 while two vertical stabilizers 392 and 394 extend above the fuselage 372. Adjustable telescoping cylinders 396 and 398 extend from the outer ends of the front wings 368 and 370, respectively. While the telescopic cylinder 396 is mechanically connected to the end of the left front wing 368 at the attachment point 390, it is electrically isolated from it. In contrast, the telescopic cylinder 398 is both mechanically and electrically connected to the end of the right front wing 370. The arrangements at the ends of the left and right front wings can be flipped or the arrangement at the end of the left front wing can be replicated on the right front wing simultaneously to use the two resulting monopole antennae in space diversity or array mode. The entire arrangement can be replicated using the horizontal stabilizers to cover a different frequency band or in combination with the front wings to realize more sophisticated antenna arrangements. The extended antenna monopole arrangement is applicable to both small collapsible-wing and large fixed-wing aircraft.

Extended Vertical Stabilizer Monopole Antenna Configuration

The vertical stabilizer monopole configuration uses the vertical stabilizers and the aircraft fuselage to create monopole antennas. Telescoping cylinders are electrically connected to the vertical stabilizers, and the vertical stabilizers are electrically isolated from the fuselage. The antenna is fed by attaching the center conductor of the coaxial antenna feed cable to the vertical stabilizer and attaching the ground of the coaxial feed to the edge of the fuselage. By extending or retracting the telescoping cylinder, the frequency of operation of the antenna can be changed.

Figure 18:
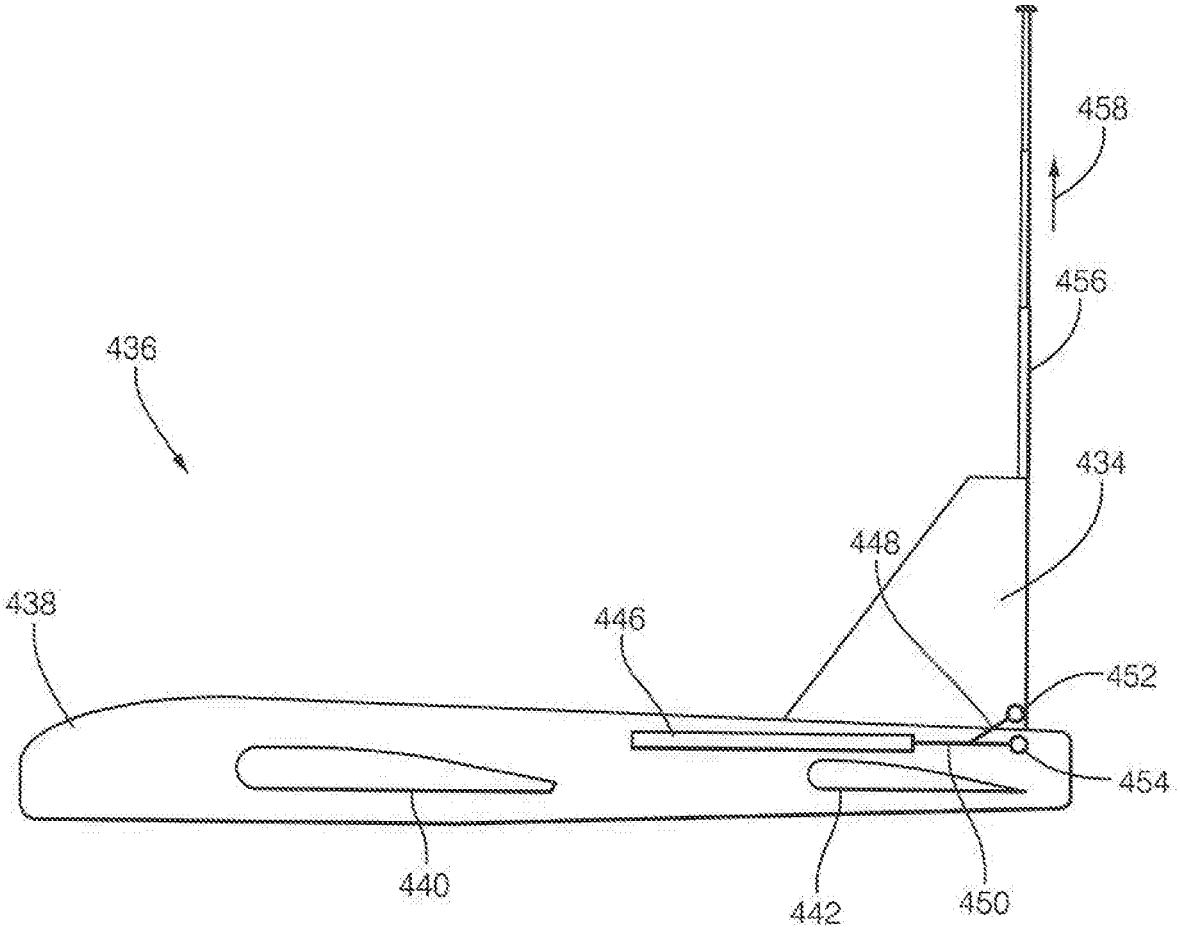
FIG. 18; is an extended vertical stabilizer monopole antenna with a vertically telescoping cylinder electrically connected to the vertical stabilizer(s), and the vertical stabilizer(s) is/are electrically isolated from the fuselage.

Referring to FIG. 18, the present invention employs using the vertical stabilizers 434 (only 1 is illustrated) of a small UAV aircraft 436 as elements of a directional antenna. The aircraft 436 comprises a fuselage 438, an opposed pair of main wings 440, an opposed pair of horizontal stabilizers 442. The inner coaxial lead 448 of the antenna feed cable 446 connects to one of the vertical stabilizers 434 at a connection point 452 and the outer coaxial lead 450 connects to the fuselage 438 at a second connection point 454. The antenna feed cable 446 interconnects to a transceiver (e.g.; transmitter, receiver or combination thereof) on the opposite end. At least one electrically connecting adjustable telescoping cylinder 456 extends from the upper ends of one or both of the vertical stabilizers 434, and adjusts the operating frequency by altering its length 458.

The embodiments of the present invention allows lowering of the operational frequency of the antenna below what is achievable by using the methods described in the parent application hereto without compromising the antenna efficiency. This potentially lowers the operating frequency down to HF frequencies on small UAV platforms, which is not conceivable with traditional methods. The present invention also provides a method to dynamically tune the antenna length during flight. Lastly, the invention is applicable to large fixed-wing aircraft also, where the entire airframe is one continuous conductor and is more easily implemented when contrasted with the inventions described and claimed in the parent application. The methods described here allow realization of high efficiency HF-band antennae with minimum alteration to the airframe.

The following documents are deemed to provide a fuller background disclosure of the inventions described herein and the manner of making and using same. Accordingly, each of the below-listed documents is hereby incorporated into the specification hereof by reference.

U.S. Pat. No. 2,510,698 to Johnson entitled "Radio Aerial, Particularly for Aircraft and Other Vehicles".

U.S. Pat. No. 3,365,721 to Bittner entitled "Current Discontinuity Device".

U.S. Pat. No. 3,587,102 to Czerwinski entitled "Helicopter Skid Antenna".

U.S. Pat. No. 3,564,134 to Rue entitled "Two-Camera Remote Drone Control".

U.S. Pat. No. 3,646,562 to Acker et al. entitled "Helical Coil to a Live Tree to Provide a Radiating Antenna".

U.S. Pat. No. 3,701,157 to Uhrig entitled "Helicopter UHF Antenna System for Satellite Communications".

U.S. Pat. No. 3,742,495 to Diamantides entitled "Drone Guidance System and Method".

U.S. Pat. No. 4,100,546 to Campbell et al. entitled "Airborne Antenna System Employing the Airframe as an Antenna".

U.S. Pat. No. 4,117,490 to Arnold et al. entitled "Inconspicuous Antenna System Employing the Airframe as an Antenna".

U.S. Pat. No. 5,231,409 to Astier et al. entitled "Microwave Antenna Capable of Operating at High Temperature, in Particular for a Space-Going Aircraft".

U.S. Pat. No. 6,119,976 to Rogers entitled "Shoulder Launched Unmanned Reconnaissance System".

U.S. Pat. No. 7,053,812 B2 to Trainor entitled "Recoverable Pod for Self-Protection of Aircraft Using a Recoverable Pod".

U.S. Patent Application No. 2008/0210818 A1 to Chiu et al. entitled "Autonomous Back-Packable Computer-Controlled Breakaway Unmanned Aerial Vehicle (UAV)".

U.S. Pat. No. 7,467,762 B to Parsons entitled "Advanced Unmanned Aerial Vehicle System".

U.S. Patent Application No. 2009/0322147 A1 to Cooney entitled "Aircraft with Isolated Ground".

U.S. Pat. No. 8,115,145 B2 to Shariff et al. entitled "Systems and Methods for Base Station Enclosures".

U.S. Pat. No. 8,282,040 to Westman et al. entitled "Composite Aircraft Wing".

U.S. Patent Application No. 2015/0237569 A1 to Jalali entitled "Unmanned Aerial Vehicle Communication Using Distributed Antenna Placement and Beam Pointing".

U.S. Patent Application Publication No. 2005/0236778 A1 to Jalali entitled "Broadband Access to Mobile Platforms Using Drone/UAV Background".

U.S. Pat. No. 9,337,889 B1 to Stapleford entitled "Drone Aircraft Detector".

It is to be understood that the invention has been described with reference to specific embodiments and variations to provide the features and advantages previously described and that the embodiments are susceptible of modification as will be apparent to those skilled in the an.

Furthermore, it is contemplated that many alternative, common inexpensive materials can be employed to construct the basic constituent components. Accordingly, the forgoing is not to be construed in a limiting sense.

The invention has been described in an illustrative manner, and it is to be understood that the terminology, which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for illustrative purposes and convenience and are not in any way limiting, the invention, which is defined by the following claims as interpreted according to the principles of patent law, including the Doctrine of Equivalents, may be practiced otherwise than is specifically described.

The invention claimed is:

1. An rotary wing aircraft comprising:

a fuselage assembly including a first elongated structural member formed of electrically conductive material;

a first airfoil assembly including an opposed pair of symmetrical sections consisting of an opposed pair of second elongated structural members formed of electrically conductive material which are electrically isolated from one another, a second airfoil assembly including a second opposed pair of symmetrical sections consisting of a second opposed pair of third elongated structural members formed of electrically conductive material which are electrically isolated from one another;

said first airfoil assembly interconnected directly or indirectly for rotation about a first fixed axis with respect to said fuselage assembly in a flight configuration wherein said first and second structural members are electrically insulated from one another, said second airfoil assembly interconnected directly or indirectly for rotation about a second fixed axis with respect to said fuselage assembly in a flight configuration wherein said first and third structural members are electrically insulated from one another;

an electronic communication device disposed within said aircraft and configurable for selective electrical interconnection of said opposed pair of second structural members to form a transmitting/receiving antenna, and/or an electronic communication device disposed within said aircraft and configurable for selective electrical interconnection of said opposed pair of third structural members to form a transmitting/receiving antenna.

2. The rotary wing aircraft of claim 1, wherein said aircraft comprises a UAV.

3. The rotary wing aircraft of claim 1, wherein said transmitting/receiving antenna comprises a rotary wing monopole antenna.

4. The rotary wing aircraft of claim 1, wherein said transmitting/receiving antenna comprises a rotary wing dipole antenna.

5. The rotary wing aircraft of claim 1, wherein said first fixed axis is concentric with said second fixed axis.

6. The rotary wing aircraft of claim 1, wherein said electronic communication device is operable for selective electrical interconnection of said pair of second structural members to form two wing dipole antennas with perpendicular polarization.

7. The rotary wing aircraft of claim 1, wherein said electronic communication device is operable for selective electrical interconnection of said first structural member with one of said pair of second structural members to form a fuselage-wing monopole antenna.

8. The rotary wing aircraft of claim 1, wherein said airfoil comprises a concentric opposed pair of horizontal stabilizers including an aligned pair of said second structural members.

9. The rotary wing aircraft of claim 6, wherein said electronic communication device is operable for selective electrical interconnection of said pair of second structural members to form a horizontal stabilizer dipole antenna.

10. The rotary wing aircraft of claim 6, wherein said electronic communication device is operable for selective electrical interconnection of said first structural member with one of said pair of second structural members to form a fuselage-horizontal stabilizer monopole antenna.

11. The rotary wing aircraft of claim 1, wherein said airfoil comprises at least one vertical stabilizer including a third elongated structural member.

12. The rotary wing aircraft of claim 11, wherein said electronic communication device is operable for selective electrical interconnection of said first structural member with said third structural member to form a vertical stabilizer monopole antenna.

13. The aircraft of claim 12, wherein said airfoil comprises a plurality of vertical stabilizers including third elongated structural members, and wherein said electronic communication device is operable for selective electrical interconnection of said first structural member with each said third structural member to form a vertical stabilizer monopole antenna array.

14. The rotary wing aircraft of claim 1, wherein said airfoil and said first structural member are synonymous, consisting of an elongated core or spar and an aerodynamically shaped outer skin.

15. The rotary wing aircraft of claim 14, wherein said outer skin is formed of carbon-fiber material.

16. The rotary wing aircraft of claim 1, wherein said airfoil assembly comprises a swing wing affixed to said fuselage.

17. The rotary wing aircraft of claim 3, wherein said airfoil assembly comprises a wingtip fence at the tip of the said wing.

18. The rotary wing aircraft of claim 3, wherein said airfoil assembly comprises a winglet extending up from the tip of said wing.

19. An aircraft comprising:

a fuselage assembly including an elongated structural member formed of electrically conductive material;

at least one wing assembly including a second structural member formed of electrically conductive material;

at least one horizontal stabilizer assembly including a third structural member formed of electrically conductive material;

at least one vertical stabilizer assembly including a fourth structural member formed of electrically conductive material, wherein said wing assembly, said horizontal stabilizer, and said vertical stabilizer are each interconnected with said fuselage assembly in a flight configuration substantially normal to said fuselage, wherein said second, third and fourth structural members are electrically insulated from one another and insulatively or electrically connected to said fuselage;

an electronic communication device disposed within said aircraft and configurable for selective electrical interconnection of one of said structural members with at least one other of said structural members to form a transmitting/receiving antenna;

wherein at least one of said wing assembly, said horizontal stabilizer, and said vertical stabilizer include a telescoping extension insulatively or electrically connected with said second, third and/or fourth structural members respectively, and displacable to affect tuning of said transmitting/receiving antenna.

20. The aircraft of claim 19, wherein said electronic communication device is configurable for selective electrical interconnection of at least two of said structural members to form a wing dipole antenna, a vertical stabilizer monopole antenna, a horizontal stabilizer dipole antenna, a vertical stabilizer monopole array antenna, a wing monopole antenna, a wing monopole antenna array, a horizontal stabilizer monopole antenna, or a horizontal stabilizer monopole antenna array.

21. The aircraft of claim 19, wherein said telescoping extension comprises an opposed symmetrical pair of extension elements.

22. The aircraft of claim 21, wherein said electronic communication device includes an electric or hydraulic power actuator operable to deploy and retract said symmetrical elements in flight.

23. The aircraft of claim 19, wherein said telescoping extension comprises a single of extension element.

24. An aircraft comprising:

a fuselage assembly including an elongated structural member formed of electrically conductive material;

at least one wing assembly including a second structural member formed of electrically conductive material;

at least one horizontal stabilizer assembly including a third structural member formed of electrically conductive material, wherein said wing assembly and said horizontal stabilizer are each interconnected with said fuselage assembly in a flight configuration substantially normal to said fuselage, wherein said second and third structural members are electrically insulated from one another and from said fuselage;

an electronic communication device disposed within said aircraft and configurable for selective electrical interconnection of one of said structural members with another of said structural members to form a transmitting/receiving antenna, wherein said electronic communication device is configurable for selective electrical interconnection of two of said structural members to form a directional Yagi antenna.

* * * * *